US008185236B2

(12) United States Patent
Kim

(10) Patent No.: US 8,185,236 B2
(45) Date of Patent: May 22, 2012

(54) MEDICINE DISCHARGE DEVICE OF AUTOMATIC MEDICINE PACKING MACHINE

(75) Inventor: Jun-Ho Kim, Daegu (KR)

(73) Assignee: JVM Co., Ltd., Daegu (KR)

( * ) Notice: Subject to any disclaimer, the term of this patent is extended or adjusted under 35 U.S.C. 154(b) by 378 days.

(21) Appl. No.: 12/616,377

(22) Filed: Nov. 11, 2009

(65) Prior Publication Data

US 2010/0116837 A1 May 13, 2010

(30) Foreign Application Priority Data

Nov. 13, 2008 (KR) ..... 10-2008-0112852
Nov. 26, 2008 (KR) ..... 10-2008-0118172
Mar. 3, 2009 (KR) ..... 10-2009-0017897
Oct. 19, 2009 (KR) ..... 10-2009-0099186

(51) Int. Cl.
*G06F 17/00* (2006.01)

(52) U.S. Cl. ..... 700/242; 700/232; 700/236; 221/220

(58) Field of Classification Search ..... 221/200, 221/201, 202, 203, 204; 700/231, 236, 242, 700/244

See application file for complete search history.

(56) References Cited

U.S. PATENT DOCUMENTS 4,677,283 A 6/1987 Lewis
5,444,749 A * 8/1995 Nambu ..... 700/239
5,587,572 A 12/1996 Kirby
7,210,598 B2 * 5/2007 Gerold et al. ..... 221/220
7,225,053 B2 * 5/2007 Kim ..... 700/242
7,624,894 B2 * 12/2009 Gerold et al. ..... 700/231
2008/0072534 A1 3/2008 Kim

FOREIGN PATENT DOCUMENTS

EP 1 365 354 A1 11/2003

OTHER PUBLICATIONS

European Search Report issued in European Application No. 09175960.5 on Mar. 29, 2010.

* cited by examiner

*Primary Examiner* — Timothy Waggoner

(74) *Attorney, Agent, or Firm* — Kile Park Goekjian Reed & McManus PLLC

(57) ABSTRACT

Disclosed is a medicine discharge device of an automatic medicine packing machine, which is used to discharge a medicine, fed from a medicine cassette based on a medical prescription, into a medicine packing device. The medicine discharge device includes a medicine input unit installed under a medicine cassette mount to receive the medicine fed from the medicine cassette, a frame provided with a gate unit, the gate unit including gate members to be opened or closed by a drive unit so as to control movement of the medicine discharged from the medicine input unit, a plate installed under the frame and having an accommodation portion to receive the medicine and a recess to allow the medicine to be moved from the gate members to a discharge passage, a vibrator to vibrate the plate, and a medicine transfer unit to discharge the medicine, having passed through the recess, into a hopper.

15 Claims, 22 Drawing Sheets

(a)

(b)

MEDICINE DISCHARGE DEVICE OF AUTOMATIC MEDICINE PACKING MACHINE

BACKGROUND OF THE INVENTION

1. Field of the Invention

The present invention relates to a medicine discharge device of an automatic medicine packing machine, which is designed to discharge a medicine, fed from a medicine cassette based on a medical prescription, into a packing device.

2. Description of the Related Art

FIG. 1 is a schematic front view of a conventional automatic medicine packing machine. Referring to FIG. 1, the conventional automatic medicine packing machine includes a body 100, a plurality of medicine cassettes 110 arranged in an upper region of the body 100, each of which is mounted on a medicine cassette mount and is configured to store a medicine, such as various sizes and shapes of tablets, capsules, etc., and a hopper 130 arranged in a lower region of the body 100 to collect the medicine dropped from the medicine cassettes 110. In addition, the conventional automatic medicine packing machine includes a printing device 140 to print a variety of information on a paper surface of a packing pouch used to pack the medicine, and a packing device 150 to pack the medicine, collected by the hopper 130, into the packing pouch.

In the above described conventional automatic medicine packing machine, each of the medicine cassettes includes a medicine cassette body in which a medicine, such as various sizes and shapes of tablets, capsules, etc., is stored, and a division block rotatably provided in the cassette body to allow the medicine to be individually discharged from the cassette body. To realize rotational driving of the division block, a motor is mounted in the cassette mount that is used to support the cassette body.

The division block is formed in an outer peripheral surface thereof with a plurality of discharge grooves, so that the medicine received in the cassette body is discharged out of the cassette body by being moved along the discharge grooves. However, the discharge grooves employed in the conventional medicine cassette are shaped to allow movement of only a standard shape of medicine. Therefore, if a physician or a pharmacist prescribes a non-standard irregularly-shaped medicine, such as, e.g., a half tablet obtained by cutting a tablet into halves, it may be impossible for the conventional medicine cassette to accurately discharge the medicine.

For this reason, the conventional automatic medicine packing machine requires installation of an additional manual tray on which a person will manually dispense the prescribed irregularly-shaped medicine, such as a half tablet. This may disadvantageously increase time and efforts for a medicine packing operation. Moreover, manually handling a medicine may risk contamination of the medicine.

SUMMARY OF THE INVENTION

Therefore, the present invention has been made in view of the above problems, and it is an object of the present invention to provide a medicine discharge device usable with an automatic medicine packing machine, which is capable of accurately individually discharging even a non-standard irregularly-shaped medicine, such as a half tablet obtained by cutting a tablet into halves, as well as a standard shape of medicine.

In accordance with an aspect of the present invention, the above and other objects can be accomplished by the provision of a medicine discharge device of an automatic medicine packing machine, which is used to discharge a medicine, fed from a medicine cassette based on a medical prescription, into a medicine packing device, the medicine discharge device including a medicine input unit installed under a medicine cassette mount, the medicine input unit being adapted to receive the medicine fed from the medicine cassette based on the medical prescription under control of a control unit and to discharge the medicine downward, a frame provided with a gate unit, the gate unit including a pair of gate members adapted to be opened or closed by a drive unit so as to control movement of the medicine discharged from the medicine input unit, a plate installed under the frame and having an accommodation portion to receive the medicine in a space surrounded by the frame and the pair of gate members and a recess to allow the medicine having passed through the gate members to be moved to a discharge passage, a vibrator to vibrate the plate, and a medicine transfer unit to discharge the medicine, having passed through the recess, into a hopper, so as to discharge the medicine into the medicine packing device.

The medicine input unit may include a medicine input body separably mounted in the automatic medicine packing machine in a sliding movable manner, an intermediate hopper separably inserted in the medicine input body to receive the medicine, and an opening/closing door installed to be pivotally rotated about a pivot shaft based on a signal from the control unit so as to open or close a bottom of the intermediate hopper.

The medicine input unit may include a cylindrical or a funnel-shaped upper input body to receive the medicine so as to allow the medicine to be discharged to the accommodation portion, a lower input body located under the upper input body and having an opening for discharge of the medicine, and a rotatable opening/closing member adapted to be rotated by a motor within the lower input body so as to open or close the opening.

The frame may be further provided with a first detection sensor at a position immediately downstream of the gate unit to confirm whether or not the medicine, which has been discharged from the medicine input unit to the accommodation portion, passes through the gate unit, and a second detection sensor to confirm whether or not the medicine is discharged from the plate.

The discharge passage may be provided with a sensor to monitor whether or not the medicine passes through the discharge passage and to count the medicine to be discharged, the sensor including a plurality of light emitters and light receivers.

A pin member may protrude from a distal end of the plate so that the medicine dropped from the plate is temporarily caught by the pin member, the pin member serving to temporarily reduce a drop speed of the medicine so as to assure an accurate counting operation by the sensor.

The plate may be made of a transparent material and a detection sensor is integrally mounted in the plate.

The plate may include a first plate and a second plate spaced apart from each other, and the vibrator may include a pair of vibrators to vibrate the first plate and the second plate individually.

The drive unit may include an elastic member connected between the pair of gate members, pulling strings connected respectively to the pair of gate members, and a rotating member to wind or unwind the pulling strings by operation of a drive motor.

The drive unit may include a cam member adapted to be rotated by a drive motor, a driving member adapted to be rectilinearly moved under guidance of the cam member, and rollers arranged at opposite ends of the driving member to come into contact with rolling surfaces of the gate members, and the driving member may be pressed toward the cam member by an elastic member, so as to continuously come into close contact with the cam member.

The recess may generally have a U-shaped or V-shaped cross section, and may consist of linear regions and tapered regions arranged alternately along a center axis thereof.

The recess may be formed with at least one of a convex portion and a concave portion to prevent rolling of the medicine being moved along the recess.

The medicine transfer unit may include an auxiliary hopper installed to be rectilinearly movable forward or rearward between a rearwardly moved position where the medicine, discharged from the discharge passage, drops into the hopper and a forwardly moved position where the medicine, discharged from the discharge passage, drops into a collector vessel that is used to collect residual medicine remaining after completion of a medicine packing operation, and a rectilinear movement unit to rectilinearly move the auxiliary hopper forward or rearward using a motor and a screw rod to be rotated by the motor.

The medicine transfer unit may include a pivoting discharge member installed to the frame and adapted to be pivotally rotated by a motor so as to convert a discharge direction of the medicine from the discharge passage, a connection passage provided under the pivoting discharge member to transfer the medicine from the pivoting discharge member to the hopper, a collection passage arranged parallel to the connection passage under the pivoting discharge member to collect a medicine not transferred to the hopper, and a transfer passage vertically penetrating through the interior of the pivoting discharge member to selectively transfer the medicine from the pivoting discharge member to the connection passage or the collection passage by adjusting a pivoting angle of the pivoting discharge member.

The pivoting discharge member may include a concave receptacle to temporarily receive the medicine, the medicine received in the receptacle being selectively transferred to the collection passage or the connection passage as the pivoting discharge member is pivotally rotated clockwise or counterclockwise.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a medicine discharge device according to preferred embodiments of the present invention will be described in detail with reference to the accompanying drawings.

In the present invention, the term "irregularly-shaped medicine" denotes a medicine having an asymmetric shape, rather than having a standard shape, such as, e.g., a semicircular or semi-elliptical half tablet obtained by cutting a circular or elliptical tablet into halves.

The medicine discharge device according to the present invention is designed to accurately individually discharge not only a standard shape of medicine, such as tablets or capsules, but also the non-standard irregularly-shaped medicine. To realize the accurate individual discharge of medicine, it is noted that it is necessary to align a pile of medicine so that respective tablets of medicine are spaced apart from one another by a predetermined distance. If the respective tablets of medicine are arranged excessively close to one another, there is a risk of discharging one or more tablets of medicine simultaneously by inertia.

Hereinafter, the medicine discharge device according to a first exemplary embodiment of the present invention will be described with reference to FIGS. 2 to 11.

Figure 1:
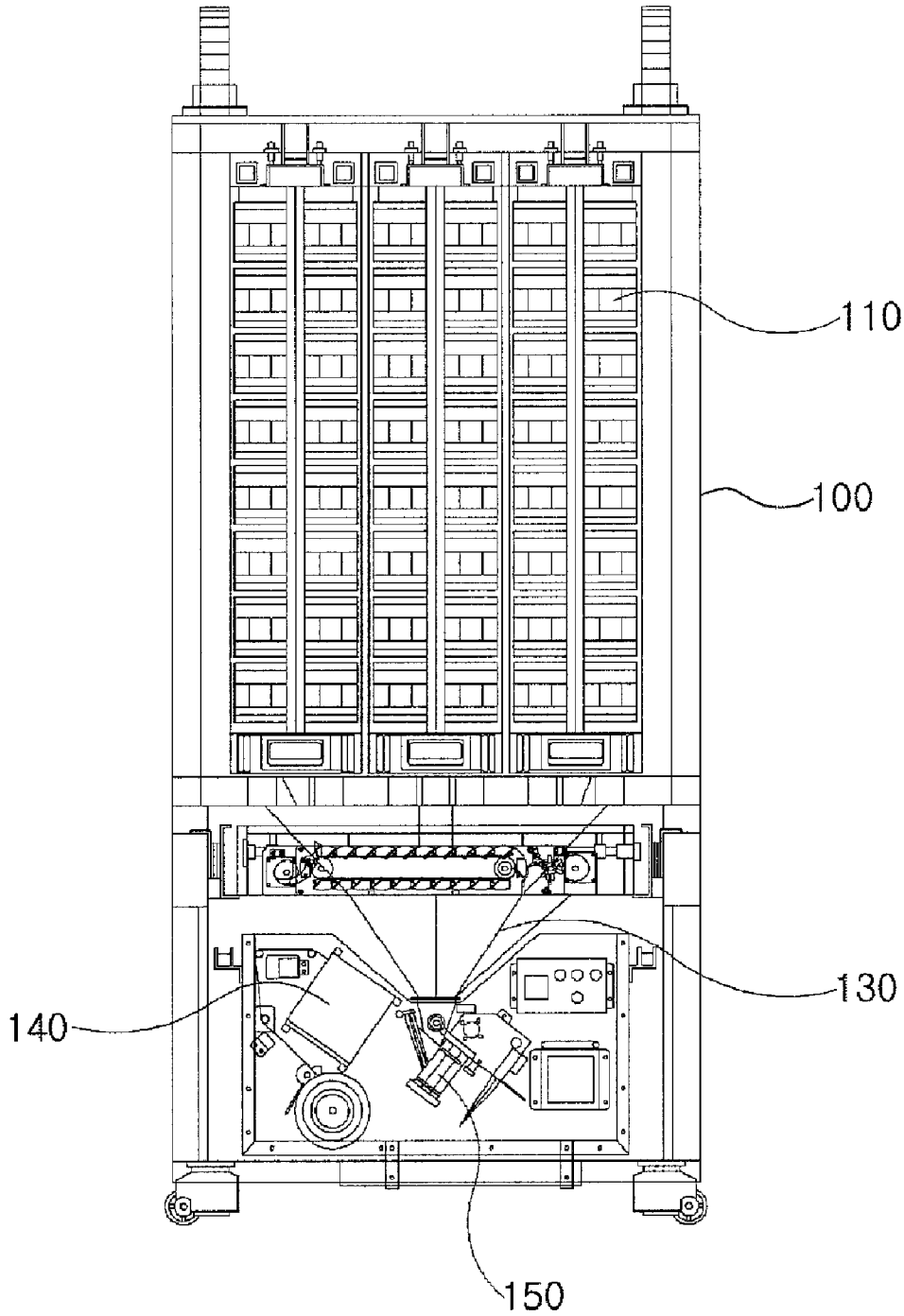
FIG.1 Prior Art
FIG. 1 is a schematic front view of a conventional automatic medicine packing machine.
Figure 2:
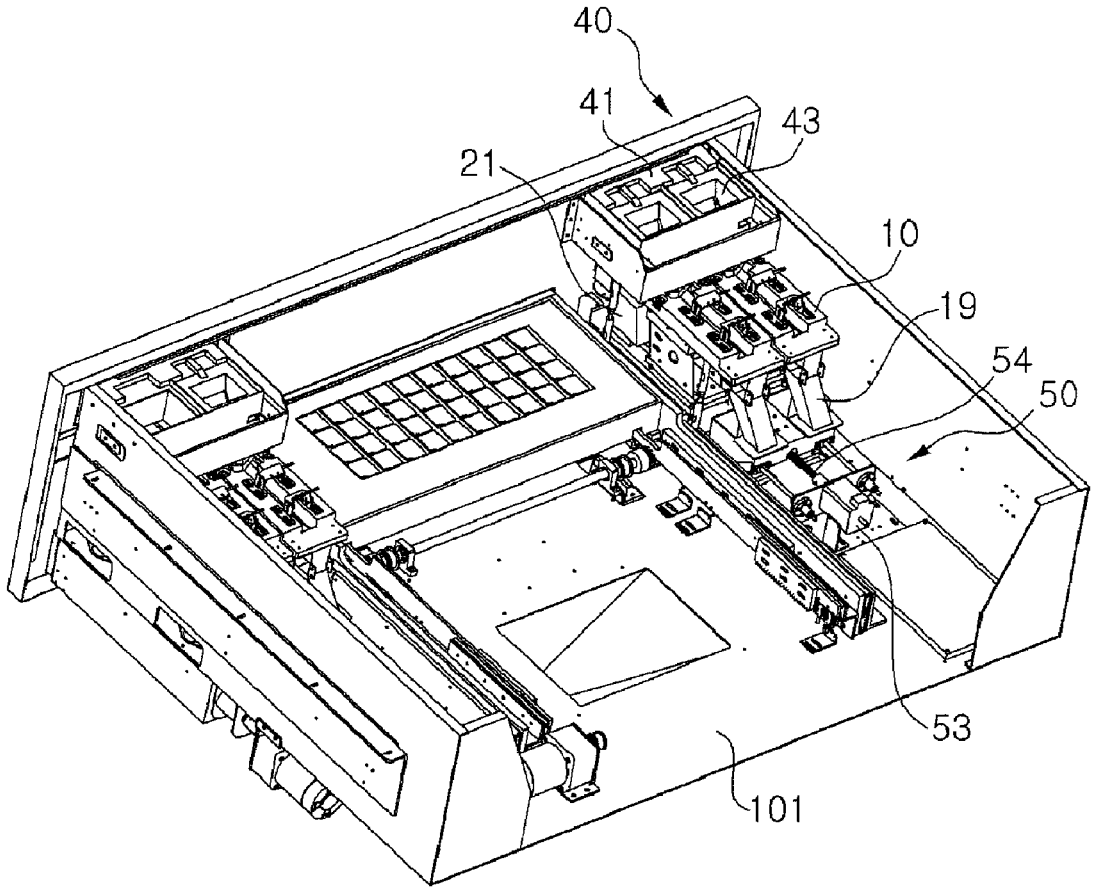
FIGS. 2 and 3 are respectively a perspective view and a side sectional view illustrating a medicine discharge device mounted to an internal structure of an automatic medicine packing machine according to a first exemplary embodiment of the present invention.
Figure 3:
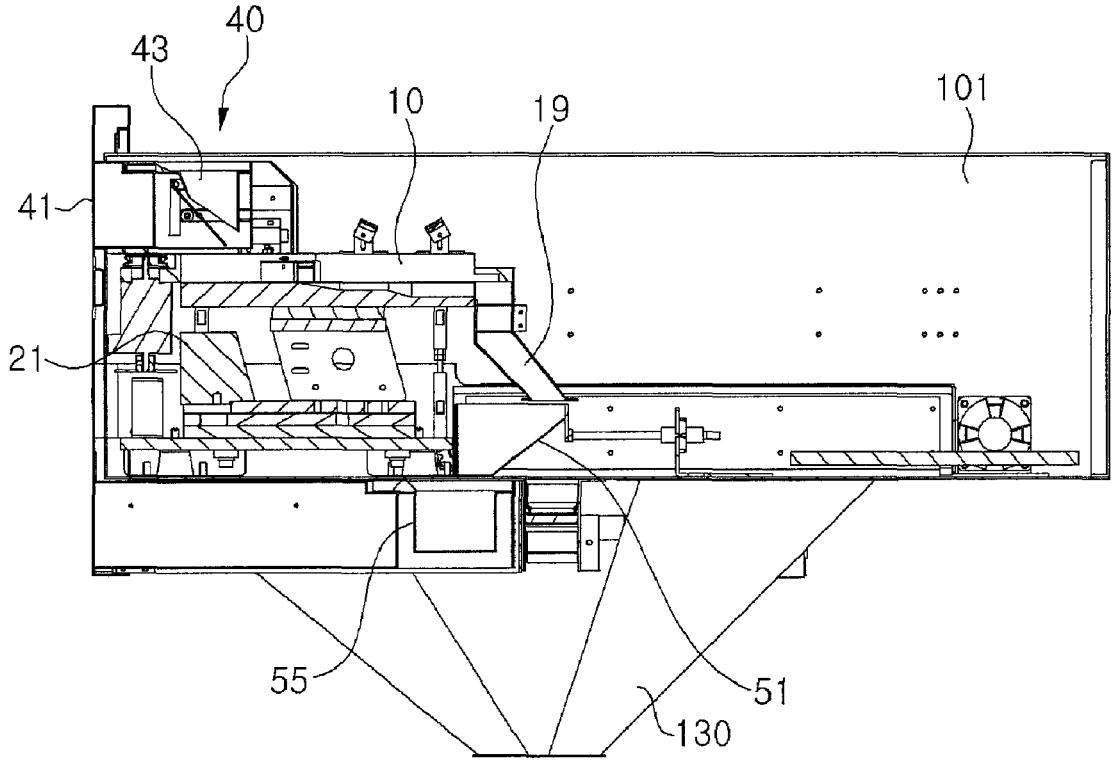
Figure 4:
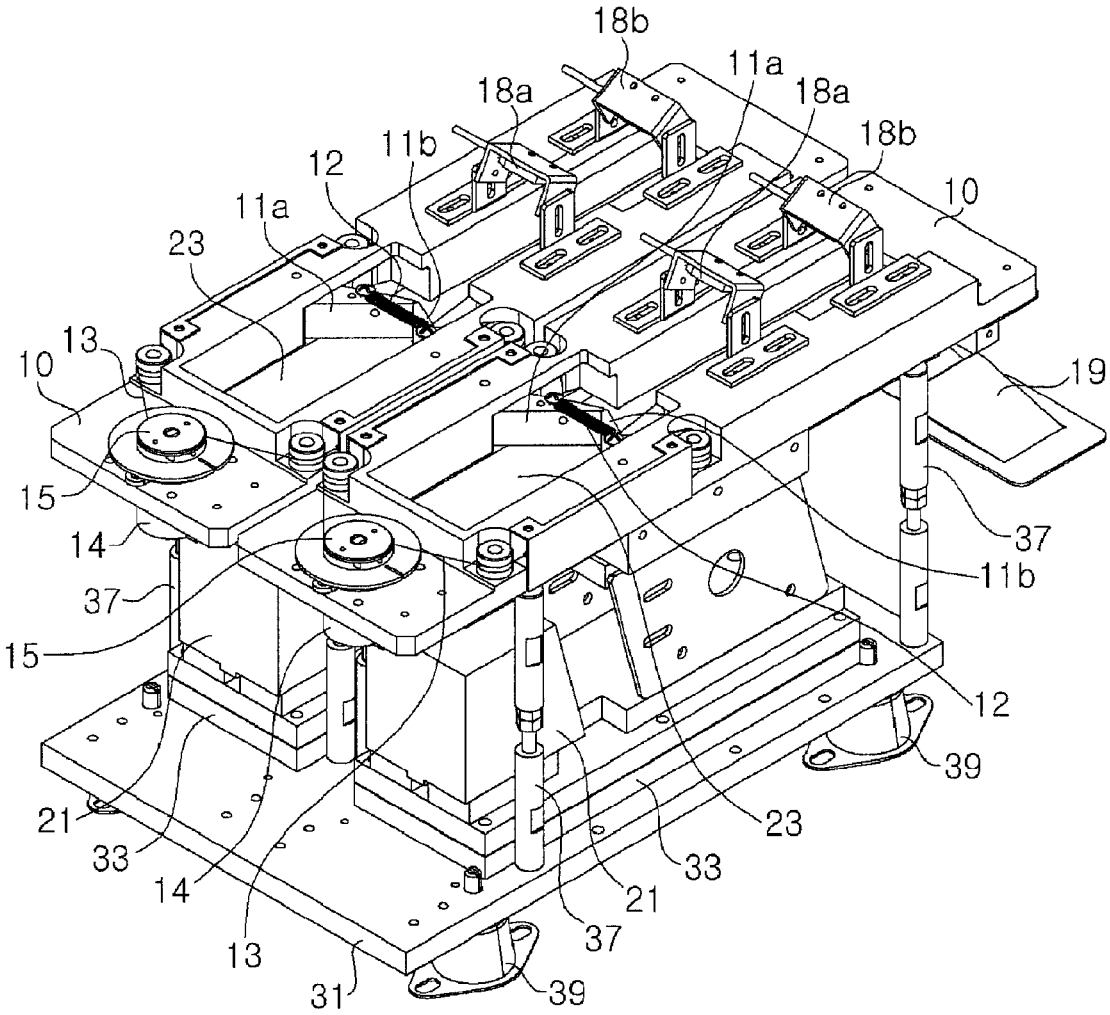
FIGS. 4 to 6 are respectively a perspective view, a side sectional view, and a plan view illustrating important parts of the medicine discharge device according to the first exemplary embodiment of the present invention.
Figure 5:
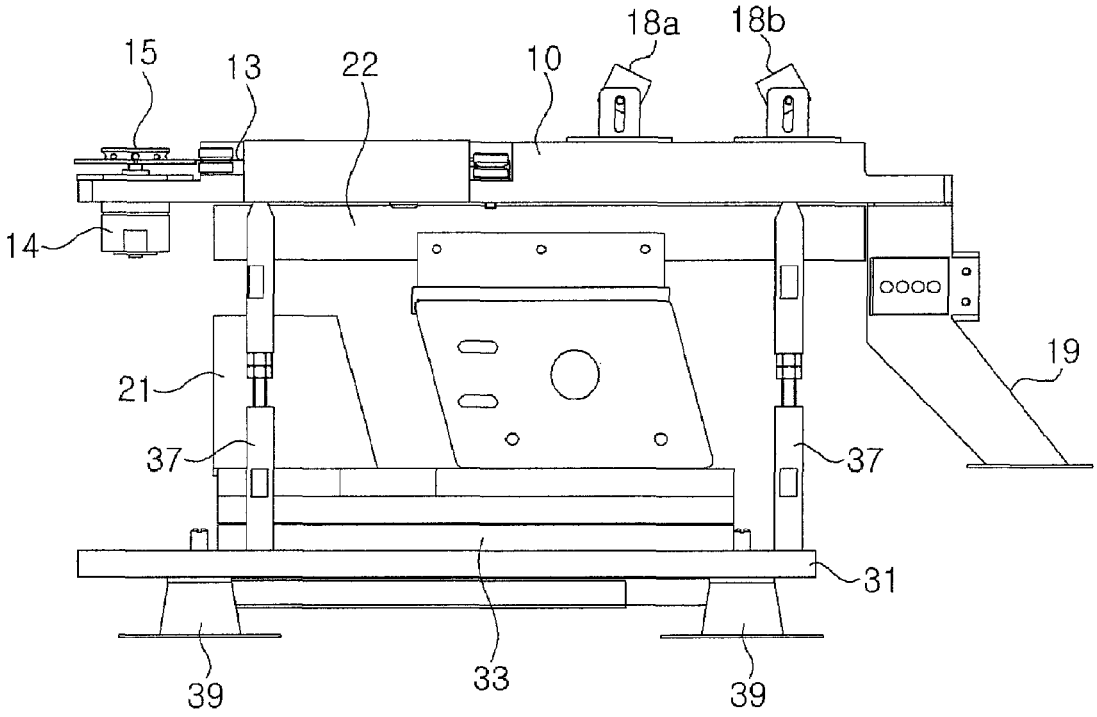
Figure 6:
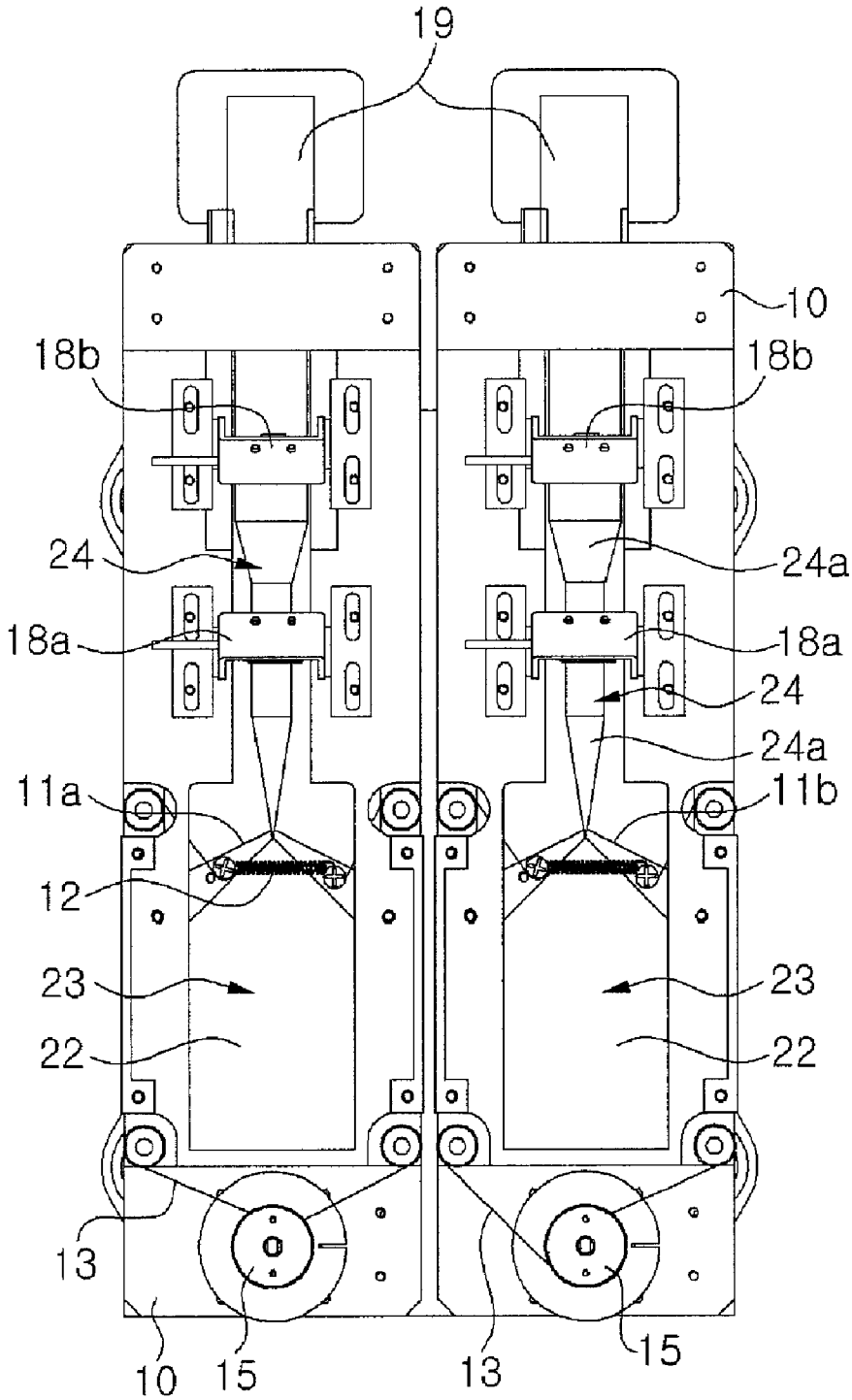
Figure 7:
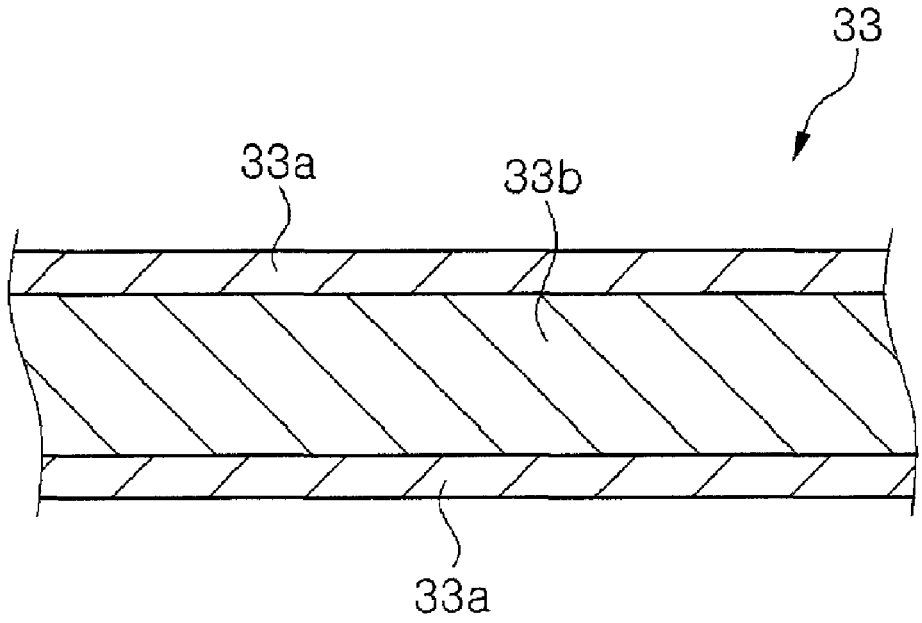
FIG. 7 is a partial sectional view of a vibration-proof member included in the medicine discharge device according to the first exemplary embodiment of the present invention.

FIG. 2 is a perspective view illustrating the medicine discharge device mounted to an internal structure of an automatic medicine packing machine according to the first exemplary embodiment of the present invention, and FIG. 3 is a side sectional view of FIG. 2. FIG. 4 is a perspective view illustrating important parts of the medicine discharge device according to the first exemplary embodiment of the present invention, and FIGS. 5 and 6 are respectively a side sectional view and a plan view illustrating the important parts of the medicine discharge device according to the first exemplary embodiment of the present invention. Also, FIG. 7 is a partial sectional view of a vibration-proof member included in the medicine discharge device according to the first exemplary embodiment of the present invention.

As shown in FIGS. 2 to 6, the medicine discharge device according to the first embodiment of the present invention includes a frame 10 provided with an opening/closing gate unit, a vibration unit arranged under the frame 10 to move a medicine via vibration, and a supporting unit on which the frame 10 and the vibration unit are supported.

The medicine discharge device according to the first embodiment of the present invention further includes a medicine input unit 40 arranged above the frame 10 to feed a desired medicine one by one into the vibration unit, and a medicine transfer unit 50 to transfer a medicine, discharged one by one through the vibration unit, to a hopper 130.

As shown in FIGS. 4 to 6 in more detail, the frame 10 incorporates thereon the gate unit, an opening/closing rate of which is adjusted to pass a medicine one by one therethrough. In addition, the frame 10 incorporates a drive unit to apply an opening/closing drive force to the gate unit, one or more detection sensors 18*a* and 18*b* to monitor discharge of a medicine, and a discharge passage 19 to guide a medicine to be discharged.

The gate unit includes a pair of left and right gate members 11*a* and 11*b*, and an elastic member 12 connected between the gate members 11*a* and 11*b* to keep the gate members 11*a* and 11*b* in a closed state.

The drive unit, which functions to open the gate members 11*a* and 11*b* in opposition to elasticity of the elastic member 12, includes pulling strings 13 connected respectively to the pair of left and right gate members 11*a* and 11*b*, and a rotating member 15 adapted to be driven by a drive motor 14 so as to wind or unwind the pulling strings 13.

The one or more detection sensors include a first detection sensor 18*a* mounted on the frame 10 at a position immediately downstream of the gate unit to confirm whether or not a medicine, which has been discharged from the medicine input unit, passes through the gate unit, and a second detection sensor 18*b* to confirm whether or not a medicine is discharged from a plate 22 that will be described hereinafter. In addition to these two detection sensors 18*a* and 18*b*, although not shown, it is desirable that other detection sensors for monitoring discharge of a medicine be provided, for example, at locations where a medicine is discharged from a medicine reservoir, such as, e.g., a medicine cassette, into the medicine discharge device and where a medicine is discharged from the medicine discharge device to the outside. The detection sensors 18*a* and 18*b* may be photo sensors, etc.

The vibration unit includes the plate 22 mounted under the frame 10, and a vibrator 21 mounted under the plate 22 to vibrate the plate 22. The vibrator 21 may be freely selected from any conventional configuration and thus, a detailed description thereof is omitted herein.

Figure 8:
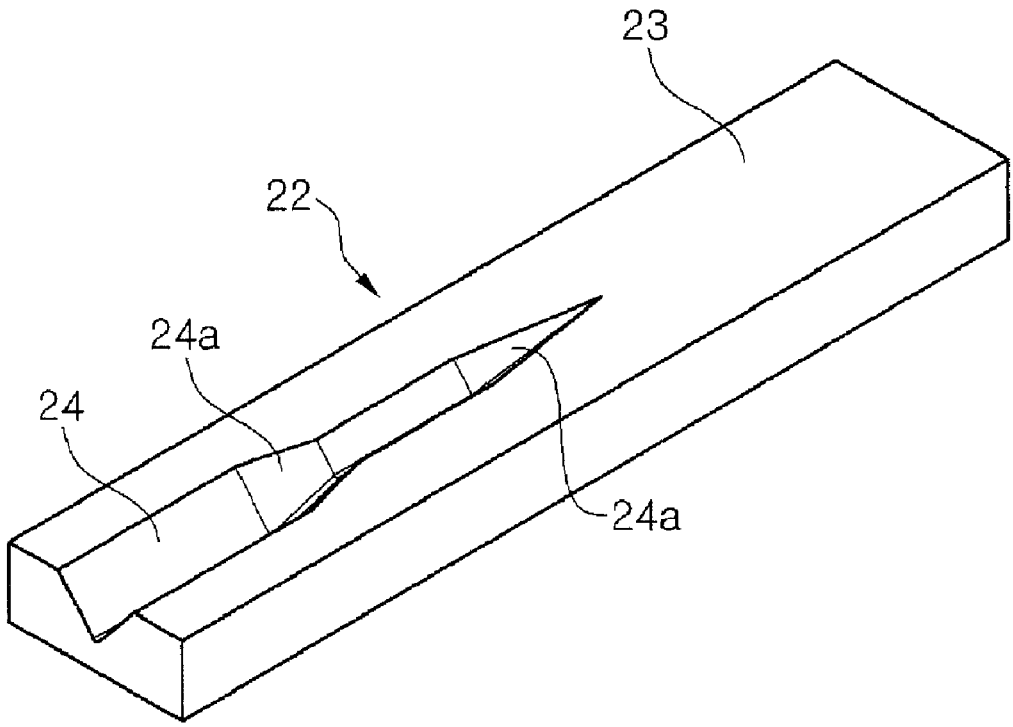
FIGS. 8 and 9 are respectively a perspective view and a side view of a plate included in the medicine discharge device according to the first exemplary embodiment of the present invention.
Figure 9:
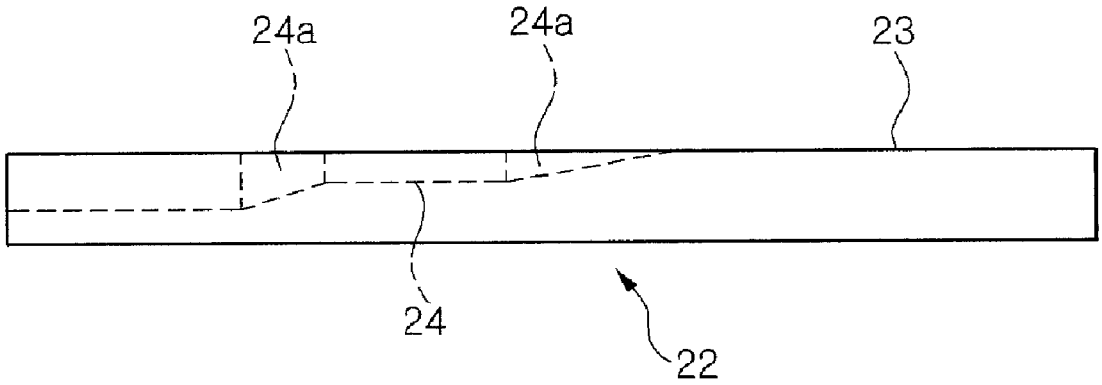

FIGS. 8 and 9 are respectively a perspective view and a side view of the plate included in the medicine discharge device according to the first exemplary embodiment of the present invention.

The plate 22 includes an accommodation portion 23 surrounded by the frame 10 and the pair of left and right gate members 11*a* and 11*b* to define a medicine accommodation space, and a recess 24 formed in the plate 22 to allow the medicine, having passed through the pair of gate members 11*a* and 11*b*, to be moved to the discharge passage 19.

Considering an installed state of the plate 22 with reference to FIG. 3, the plate 22 is slightly tilted downward toward the discharge passage 19. Accordingly, as the plate 22 is vibrated by the vibrator 21, a medicine, having passed through the pair of gate members 11*a* and 11*b*, may be gradually moved toward the discharge passage 19.

The recess 24 consists of linear regions and tapered regions 24*a* arranged alternately along a center axis of the recess 24. The tapered region 24*a* acts to accelerate a movement speed of a tablet of the medicine passing therethrough, and this has the effect of increasing a distance between the tablet of medicine and a following tablet of medicine owing to a difference in movement speeds of these tablets of medicine. By increasing a distance between the subsequent two tablets of medicine to be discharged owing to the tapered regions 24*a* of the recess 24, discharge of the medicine may be controlled one by one.

Preferably, the recess 24 generally has a U-shaped or V-shaped cross section to allow the medicine to be moved along the center axis of the recess 24. When the plate 22 is formed with a plurality of tapered regions 24*a*, the respective tapered regions 24*a* may have the same inclination as each other or may have different inclination angles from one another as occasion demands.

The plate 22, which is vibrated by the vibrator 21, may be made of a metal material, a non-metal material, or a combination thereof. In particular, it is noted that a movement speed of an irregularly-shaped medicine may be changed according to a constituent material of an upper surface of the plate 22 that comes into contact with the medicine. Therefore, it is desirable that a constituent material of the plate 22 be selected in view of a movement speed of an irregularly-shaped medicine conforming to a design demand.

For example, if the upper surface of the plate 22 is made of a metal material, the plate 22 has a low coefficient of friction, assuring a relatively high medicine movement speed on the basis of the same magnitude of vibration. On the other hand, if the upper surface of the plate 22 is made of a non-metal material, such as plastic, etc., the plate 22 has a high coefficient of friction, assuring a relatively low medicine movement speed on the basis of the same magnitude of vibration.

In addition, it is desirable that a part of the plate 22 be made of a metal material and the remaining part of the plate 22 be made of a non-metal material. More specifically, on the basis of a movement direction of an irregularly-shaped medicine, an upstream region of the plate 22 (corresponding to the accommodation portion 23), in which a relatively low movement speed of the medicine is preferable, may be made of a non-metal material, and a downstream region of the plate 22 (corresponding to the recess 24), in which a relatively high movement speed of the medicine is preferable, may be made of a metal material.

In the case where the single plate 22 is made of two or more different materials as described above, it is desirable that only the upper surface of the plate 22 that comes into contact with an irregularly-shaped medicine be made of a different material from the remaining region of the plate 22.

The supporting unit includes a bottom plate 31 on which the vibrator 21 is mounted, a vibration-proof member 33 interposed between the bottom plate 31 and the vibrator 21, and a plurality of supporting rods 37 to support the frame 10.

If necessary, supporting legs 39 may be attached to a lower surface of the bottom plate 31 and be used to install the medicine discharge device of the present invention within the automatic medicine packing machine.

Although FIGS. 2 to 4 illustrate an arrangement wherein two sets of the frames 10 and the vibration units are arranged on the bottom plate 31 parallel to each other, it may be desirable that one set of the frame 10 and the vibration unit be provided, or three or more sets of the frames 10 and the vibration units be arranged parallel to one another.

According to the first embodiment of the present invention, the vibration-proof member 33 is made of a material, which is capable of maintaining an original shape of the vibration-proof member 33, without a risk of tilting in any one direction, in opposition to the weight of a member placed on the vibration-proof member 33, capable of stopping vibration of the plate 22 simultaneously with operation stop of the vibrator 21, and capable of preventing vibration generated by operation of the vibration unit from being transmitted to the outside.

In accordance with a specific application of the present invention, the vibration-proof member 33, interposed between the vibration unit and the bottom plate 31, is preferably made of an elastic material, such as silicone, elastomer, etc., a penetration index of which is preferably in a range of 10 to 100 and more preferably, in a range of 30 to 80. If the penetration index of the silicone or elastomer of the vibration-proof member 33 is lower than 10, this is undesirable because it is impossible to sufficiently prevent vibration of the vibration unit from being transmitted to the bottom plate 31. In addition, if the penetration index is higher than 100, this is also undesirable because the vibration-proof member 33 causes the plate 22 of the vibration unit to be tilted in an unintended direction, or to be continuously vibrated by inertia even after operation of the vibration unit stops.

The vibration-proof member 33, as shown in FIG. 5, may be formed by stacking different penetration indices of silicone (silicone foam) or elastomer layers one above another in a sandwich manner. In this case, the penetration index of a first vibration-proof layer 33*a* as an uppermost or lowermost layer is preferably in a range of 5 to 50 and more preferably, in a range of 10 to 40. In addition, the penetration index of a second vibration-proof layer 33*b* as an intermediate layer is preferably in a range of 60 to 100 and more preferably, in a range of 60 to 80.

In the sandwich stacking type vibration-proof member 33 as shown in FIG. 7, the second vibration-proof layer 33*b* having a high penetration index may act to positively prevent unwanted transmission of vibration of the vibration unit, and the first vibration-proof member 33*a* having a low penetration index may act to keep the plate 22 arranged above the vibration-proof member 33 in a fixed posture while preventing the plate 22 from being vibrated by inertia immediately after operation of the vibration unit stops. Moreover, the first vibration-proof layer 33*a* and the second vibration-proof layer 33*b* of the sandwich stacking type vibration-proof member 33 may be made of different materials from each other.

In addition, the vibration-proof member 33, interposed between the vibration unit and the bottom plate 31, is preferably made of an elastic material, such as silicone, elastomer, etc., a hardness of which is preferably in a range of 1 to 10 and more preferably, in a range of 2 to 9. If the hardness of the silicone or elastomer of the vibration-proof member 33 is lower than 1, this is undesirable because it is impossible to sufficiently prevent vibration of the vibration unit from being transmitted to the bottom plate 31. In addition, if the hardness is higher than 9, this is also undesirable because the vibration-proof member 33 causes the plate 22 of the vibration unit to be tilted in an unintended direction, or to be continuously vibrated by inertia even after operation of the vibration unit stops.

The vibration-proof member 33, as shown in FIG. 5, may be formed by stacking different hardness values of silicone (silicone foam) or elastomer layers one above another in a sandwich manner. In this case, the hardness of the first vibration-proof layer 33*a* as an uppermost or lowermost layer is preferably higher than the hardness of the second vibration-proof layer 33*b* as an intermediate layer.

In the sandwich stacking type vibration-proof member 33 as shown in FIG. 7, the second vibration-proof layer 33*b* having a lower hardness may act to positively prevent unwanted transmission of vibration of the vibration unit, and the first vibration-proof member 33*a* having a higher hardness may act to keep the plate 22 arranged above the vibration-proof member 33 in a fixed posture while preventing the plate 22 from being vibrated by inertia immediately after operation of the vibration unit stops. Moreover, the first vibration-proof layer 33*a* and the second vibration-proof layer 33*b* of the sandwich stacking type vibration-proof member 33 may be made different materials.

Although FIGS. 2 to 4 illustrate the vibration-proof member 33 as being interposed between the vibration unit and the bottom plate 31, it is desirable that the vibration-proof member be positioned between the bottom plate 31 and an interior structure 101 of the automatic medicine packing machine when the medicine discharge device of the present invention is installed into the automatic medicine packing machine.

Figure 10:
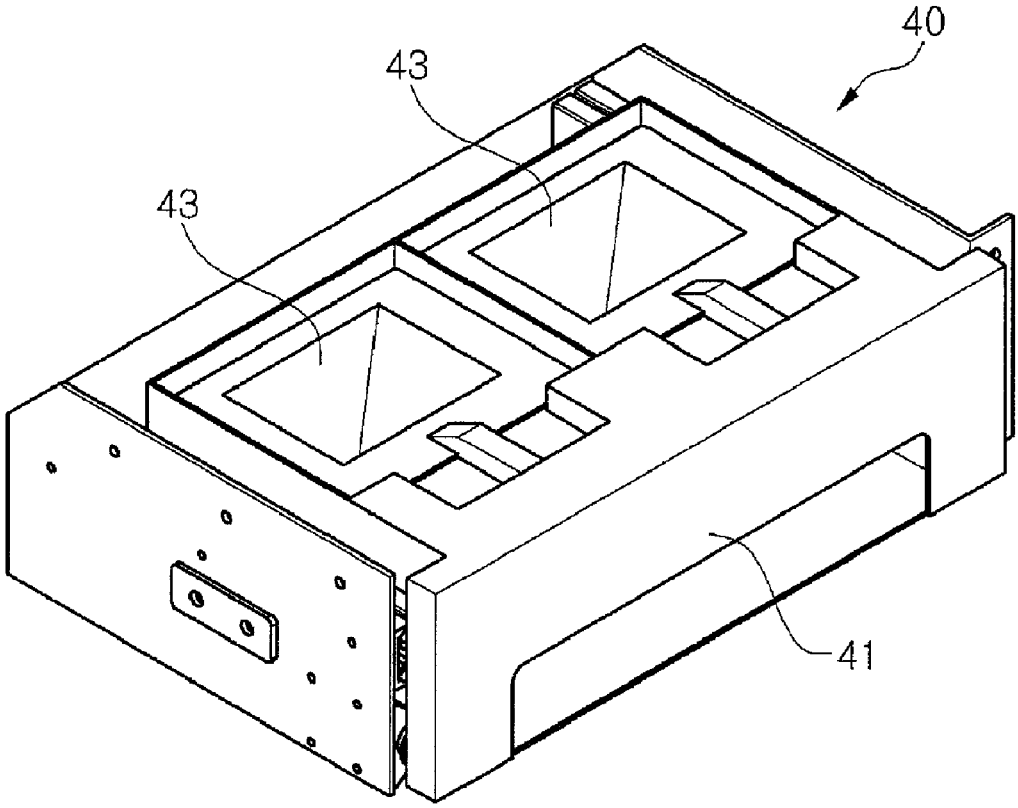
FIG. 10 is a perspective view of a medicine input unit included in the medicine discharge device according to the first exemplary embodiment of the present invention.
Figure 11:
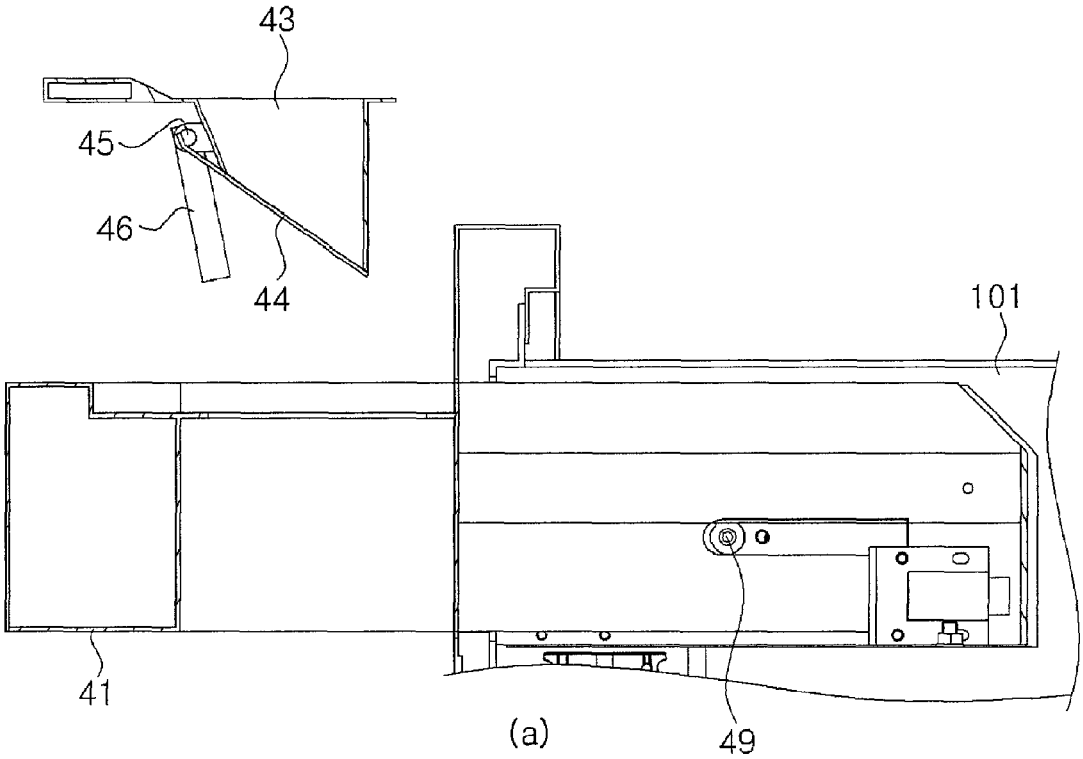
FIGS. 11(*a*) and 11(*b*) are side sectional views illustrating operation of the medicine input unit.
Figure 11:
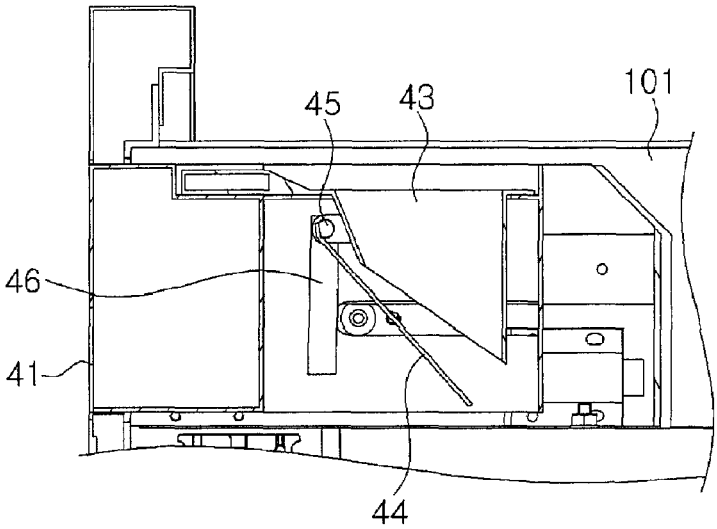

FIG. 10 is a perspective view of the medicine input unit included in the medicine discharge device according to the first exemplary embodiment of the present invention, and FIGS. 11(*a*) and 11(*b*) are side sectional views illustrating operation of the medicine input unit.

The medicine input unit 40 includes a medicine input body 41 separably mounted to a lower end of a medicine cassette mount of the automatic medicine packing machine in a sliding manner, and at least one intermediate hopper 43 separably inserted in the medicine input body 41.

The medicine input body 41 is movable in a sliding manner between an open position as shown in FIG. 11(*a*) where the intermediate hopper 43 will be inserted into or separated from the medicine input body 41 and a feed position as shown in FIG. 11(*b*) where a medicine received in the intermediate hopper 43 may be fed into the vibration unit.

An opening/closing door 44 is pivotally rotatably coupled to a pivot shaft 45 of the intermediate hopper 43, to open or close a bottom of the intermediate hopper 43. The opening/closing door 44 is integrally formed with the pivot shaft 45 and a holder member 46. When the medicine input body 41 is located at the open position, the opening/closing door 44 closes the bottom of the intermediate hopper 43 by elasticity of an elastic member (not shown). On the other hand, when the medicine input body 41 is moved into the automatic medicine packing machine and is located at the feed position, the holder member 46 is brought into contact with a protrusion 49 protruding from the automatic medicine packing machine, thereby being pivotally pushed by the protrusion 49. As the pivot shaft 45 is rotated with pivotal motion of the holder member 46, the opening/closing door 44 may be opened away from the bottom of the intermediate hopper 43.

With adoption of the separable intermediate hopper 43 as shown in FIG. 11(*a*), a user may easily remove medicine dust inside the intermediate hopper 43 by separating the intermediate hopper 43 from the medicine input body 41.

Once a medicine, which is discharged from the medicine cassette based on a medical prescription by a control unit of the automatic medicine packing machine, is introduced into the intermediate hopper 43, as shown in FIG. 11(*b*), the medicine may be fed to the accommodation portion 23 of the plate 22 located below the intermediate hopper 43 simultaneously with the opening/closing door 44 being opened.

The medicine, fed to the accommodation portion 23 of the plate 22 as described above, is adapted to pass through the gate unit one by one and is moved in a line to the recess 24 under control of the control unit.

After the medicine is discharged one by one through the recess 24 and the discharge passage 19, the medicine transfer unit 50 transfers the medicine to the hopper 130, to enable packing of the medicine. Referring again to FIGS. 2 and 3, the medicine transfer unit 50 includes an auxiliary hopper 51 installed rectilinearly movable forward or rearward (leftward or rightward in FIG. 3), a rectilinear movement unit to drive the auxiliary hopper 51, and a collector vessel 55 to collect residual medicine remaining after packing of the medicine.

The auxiliary hopper 51 is rectilinearly movable between a rearwardly moved position where the medicine, discharged one by one from the discharge passage 19, drops into the hopper 130 during a medicine packing operation and a forwardly moved position (as shown in FIGS. 2 and 3) where the medicine, discharged one by one from the discharge passage 19, drops into the collector vessel 55 for collection of the residual medicine remaining after completion of the medicine packing operation.

The rectilinear movement unit includes a motor 53 and a screw rod 54 to be rotated by the motor 53. As the screw rod 54 is rotated clockwise or counterclockwise, the auxiliary hopper 51 is rectilinearly moved forward or rearward.

The collector vessel 55 is preferably separably installed, similar to the above described intermediate hopper 43.

Figure 12:
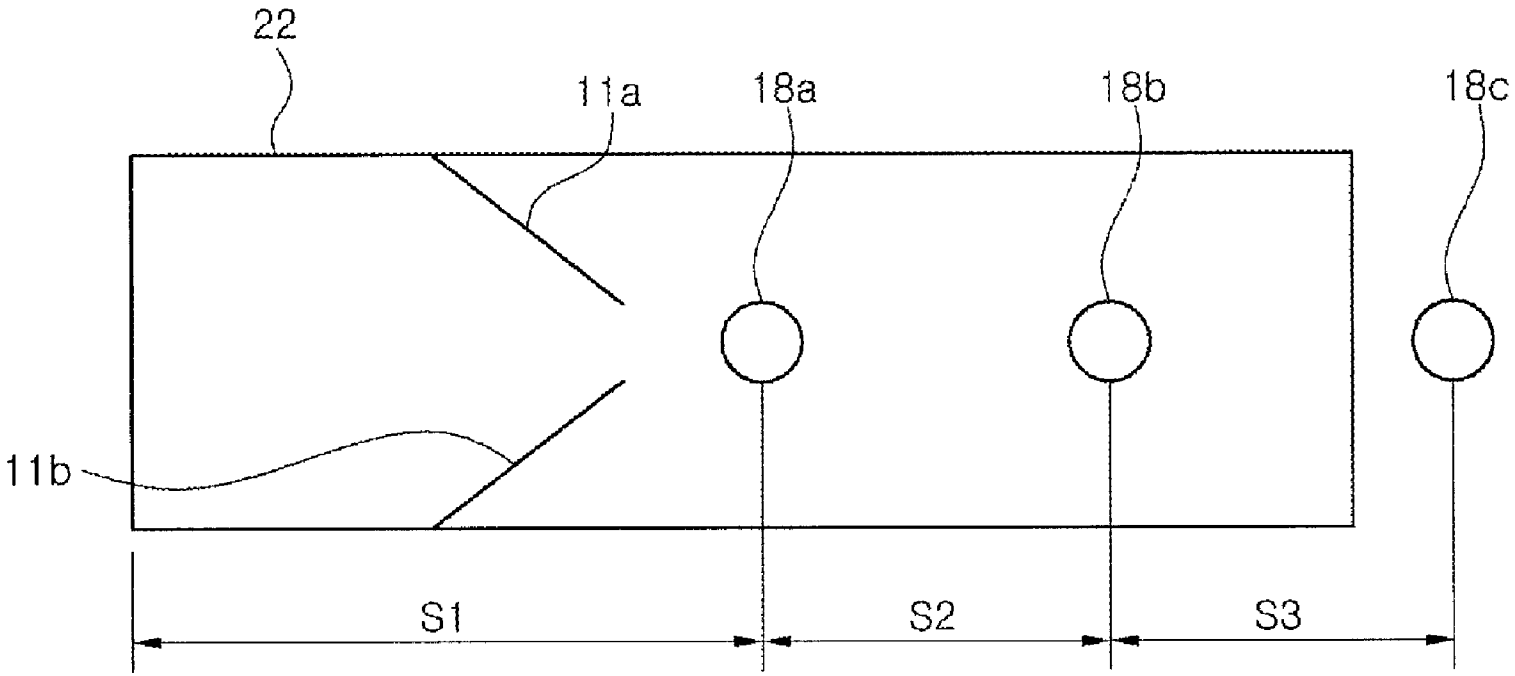
FIG. 12 is a conceptual view illustrating a process for controlling discharge of irregularly shaped medicine using sensors.

FIG. 12 is a conceptual view illustrating a process for controlling discharge of an irregularly-shaped medicine using three sensors. As shown in FIG. 12, according to the first embodiment of the present invention, the first and second detection sensors 18*a* and 18*b* and a counter sensor 18*c* may be used to control discharge of an irregularly-shaped medicine. Here, the first detection sensor 18*a* monitors whether or not the irregularly-shaped medicine passes through the gate members 11*a* and 11*b*, the second detection sensor 18*b* monitors whether or not the irregularly-shaped medicine is being moved toward a distal end of the plate 22, and the counter sensor 18*c* counts the number of tablets of the irregularly-shaped medicine discharged from the distal end of the plate 22.

Referring to FIG. 12, the irregularly-shaped medicine is moved rightward from the left side of the drawing by vibration of the plate 22. In a state wherein the irregularly-shaped medicine is normally received in the accommodation portion 23 of the plate 22, the vibrator 21 vibrates the plate 22 simultaneously with the gate members 11*a* and 11*b* being opened as described above when it is desired to discharge the medicine, whereby the irregularly-shaped medicine may begin to be discharged.

In a section S1 of FIG. 12, if the first detection sensor 18*a* senses the presence of the irregularly-shaped medicine discharged through a gap between the opened gate members 11*a* and 11*b*, an opening operation of the gate members 11*a* and 11*b* stops, maintaining a predetermined distance of the gap between the gate members 11*a* and 11*b* under control of the control unit.

Moreover, if the first detection sensor 18*a* senses the presence of an irregularly-shaped medicine that is initially discharged through the gap between the gate members 11*a* and 11*b*, the vibrator 21 vibrates the plate 22 with an increased strength, allowing a movement speed of the irregularly-shaped medicine on the plate 22 to be increased in a section S2 of FIG. 12.

The movement speed of the irregularly-shaped initial medicine is further increased in the section S2 owing to the increased vibration strength of the plate 22 and the presence of the recess 24 formed in the plate 22, whereby a distance between the irregularly-shaped initial medicine and a following medicine having passed through the gap between the gate members 11*a* and 11*b* may be further increased.

If the second sensor 18*b* senses the presence of the irregularly-shaped initial medicine being moved on the plate 22, the vibrator 21 vibrates the plate 22 by a further increased strength, allowing a movement speed of the irregularly-shaped medicine on the plate 22 to be further increased in a section S3 of FIG. 12. The vibrator 21 maintains the vibration strength in the section S3.

The irregularly-shaped medicine, having passed through the section S3, drops from the distal end of the plate 22. In this case, the counter sensor 18*c* serves not only to monitor whether the irregularly-shaped medicine passes through the discharge passage 19, i.e. the drop of the medicine, but also to count the number of the discharged irregularly-shaped tablets of medicine.

Although FIG. 2 illustrates an example wherein two pairs of four medicine discharge devices are mounted at left and right sides of the interior structure 101, of course, the present invention is not limited only to this configuration.

When a plurality of medicine discharge devices is used in a single automatic medicine packing machine in order to simultaneously discharge different kinds of a plurality of tablets of medicine, these medicine discharge devices may be arranged to discharge the irregularly-shaped tablets of medicine into a common hopper (not shown).

In addition, when the plurality of medicine discharge devices is used in the single automatic medicine packing machine, only one vibrator 21 may be used to vibrate a plurality of plates 22 simultaneously. However, even in this case where the plurality of plates 22 is vibrated by only the single vibrator 21, it is desirable that discharge of medicine from the respective medicine discharge devices be controlled individually on a per medicine discharge device basis.

The medicine discharge device according to the first embodiment of the present invention, of course, may be used to discharge not only the irregularly-shaped medicine, but also a general medicine, such as circular or elliptical tablets or capsules, etc.

Hereinafter, a medicine discharge device according to a second exemplary embodiment of the present invention will be described with reference to FIGS. 13 to 19.

Figure 13:
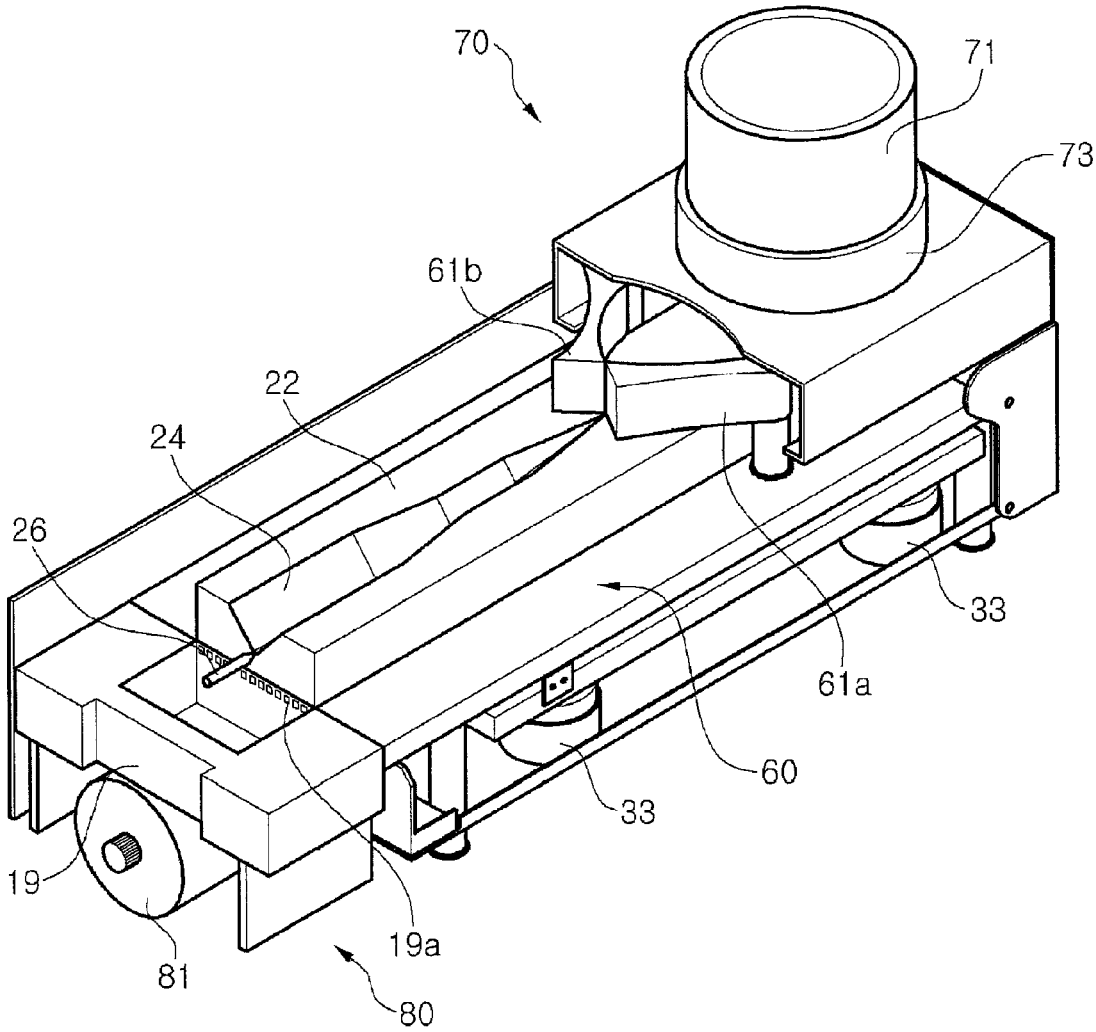
FIG. 13 is a perspective view of important parts of a medicine discharge device according to a second exemplary embodiment of the present invention.
Figure 14:
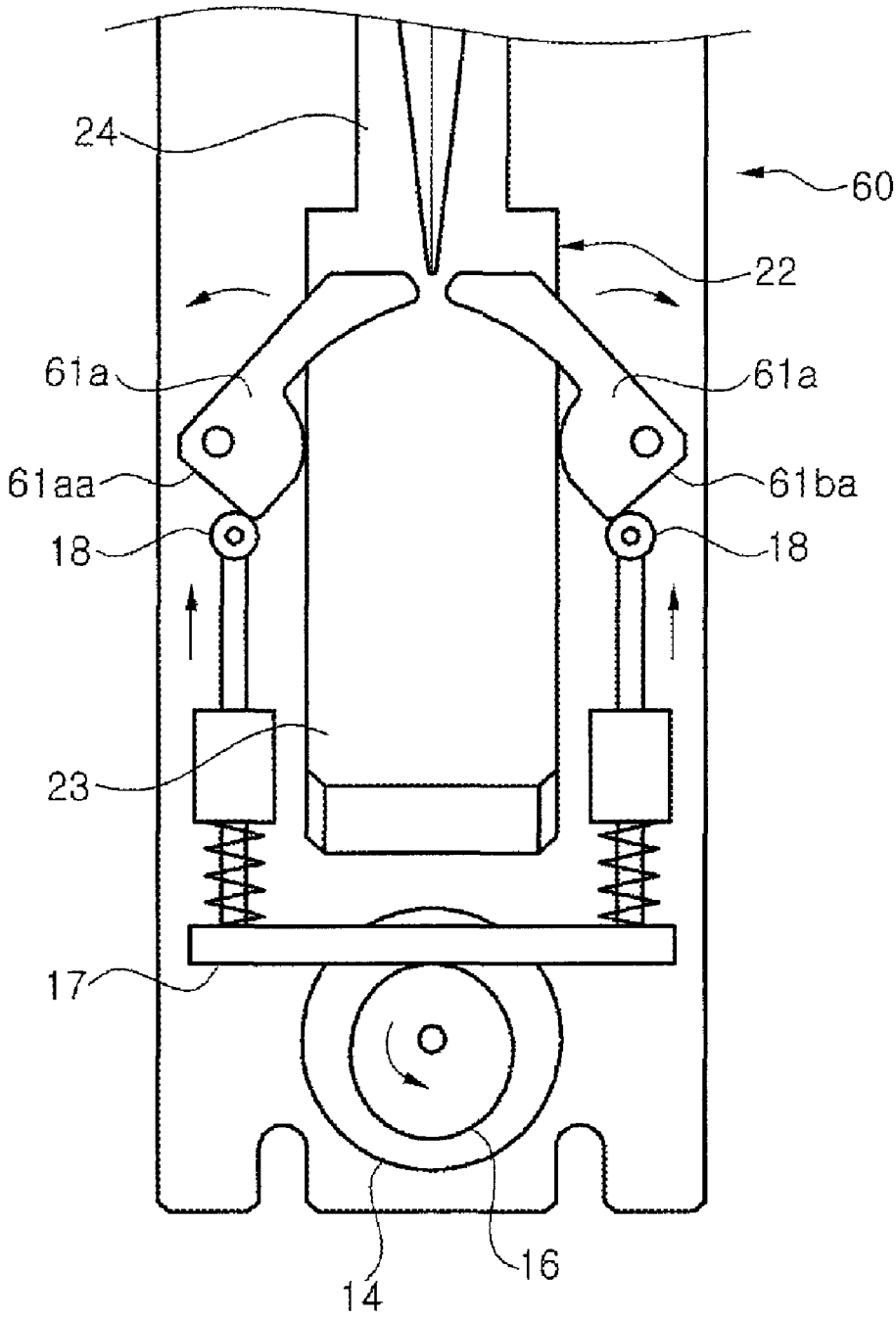
FIG. 14 is a view illustrating operation of gate members of the medicine discharge device according to the second exemplary embodiment of the present invention.
Figure 15:
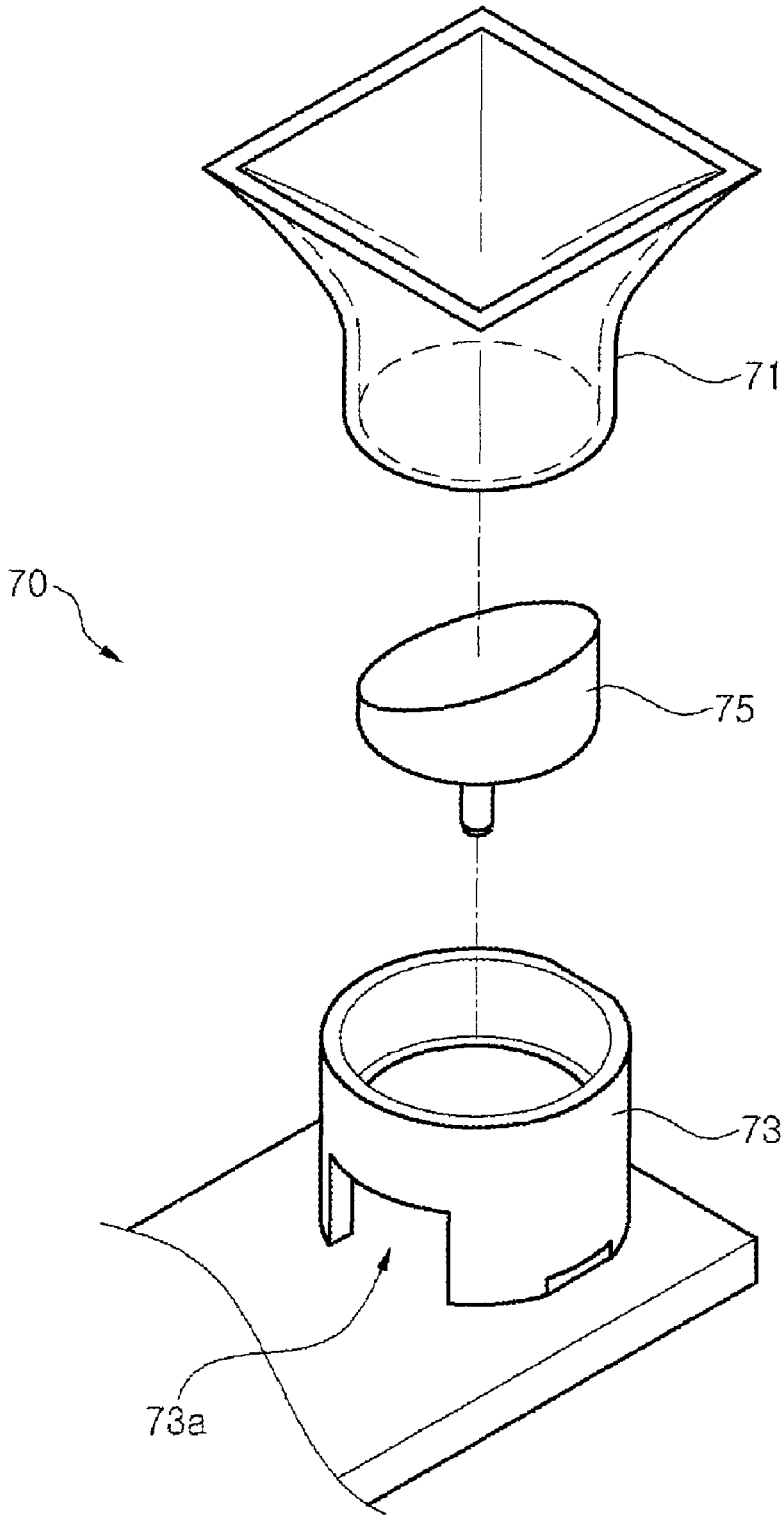
FIGS. 15 and 16 are respectively an exploded perspective view and a sectional view of a medicine input unit included in the medicine discharge device according to the second exemplary embodiment of the present invention.
Figure 16:
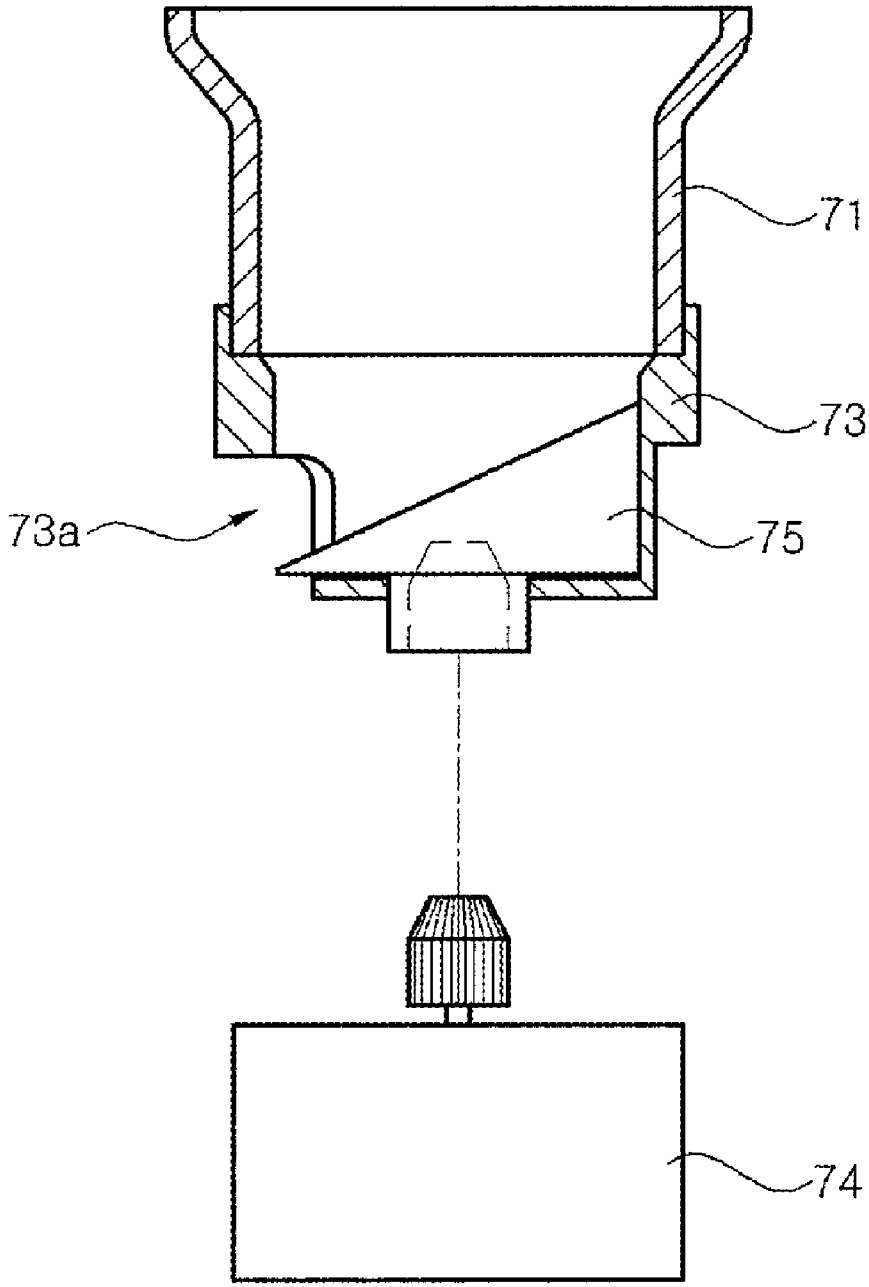
Figure 17:
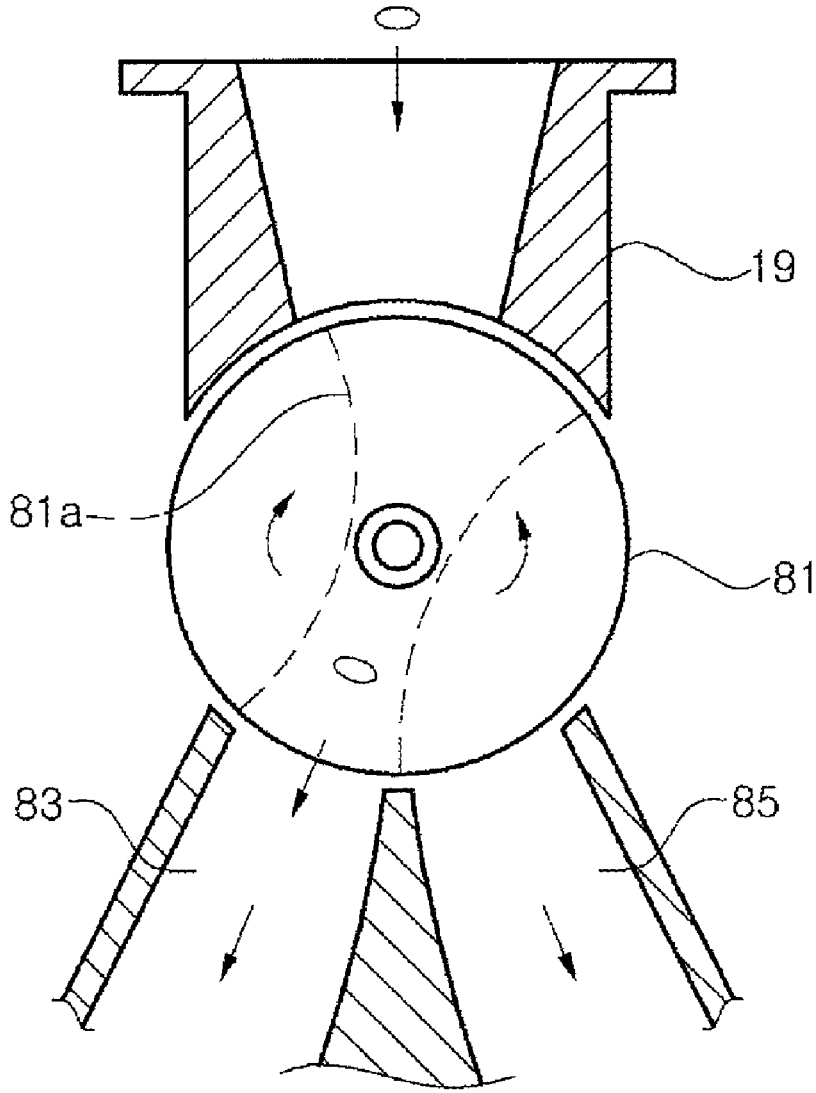
FIG. 17 is a schematic front view of a medicine transfer unit of the medicine discharge device according to the second exemplary embodiment of the present invention.
Figure 18:
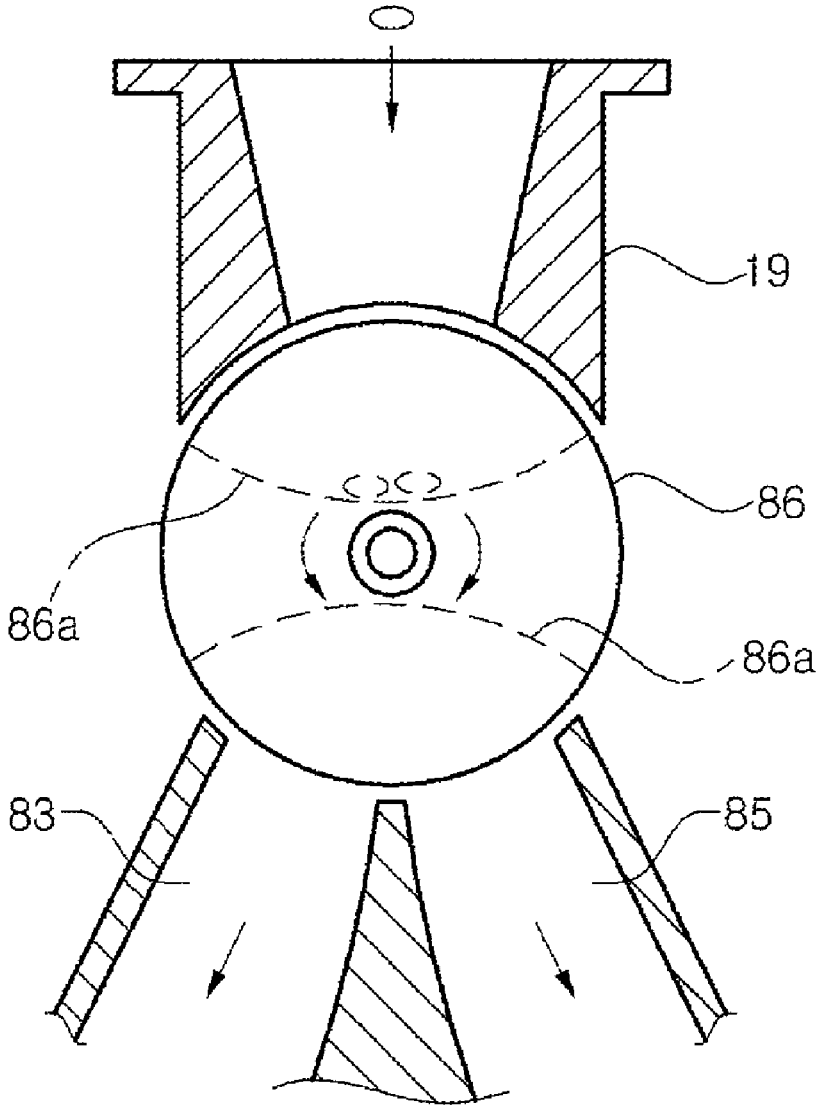
FIG. 18 is a schematic front view illustrating an alternative embodiment of the medicine transfer unit of the medicine discharge device according to the second exemplary embodiment of the present invention.

FIG. 13 is a perspective view illustrating important parts of the medicine discharge device according to the second exemplary embodiment of the present invention, and FIG. 14 is a view illustrating operation of gate members of the medicine discharge device according to the second exemplary embodiment of the present invention. FIGS. 15 and 16 are respectively an exploded perspective view and a sectional view of a medicine input unit included in the medicine discharge device according to the second exemplary embodiment of the present invention. FIG. 17 is a schematic front view of a medicine transfer unit included in the medicine discharge device according to the second exemplary embodiment of the present invention, and FIG. 18 illustrates an alternative embodiment of the medicine transfer unit.

As shown in FIG. 13, similar to the medicine discharge device according to the above described first embodiment, the medicine discharge device according to the second embodiment includes a frame 60 provided with an opening/closing gate unit, a vibration unit arranged under the frame 60 to move a medicine via vibration, a supporting unit on which the frame 60 and the vibration unit are supported, a medicine input unit 70 arranged above the frame 60 to feed a medicine into the gate unit, and a medicine transfer unit 80 to transfer the medicine, discharged one by one through the vibration unit, to the hopper 130.

Although the first embodiment illustrates a pair of two medicine discharge devices arranged below the medicine cassette, according to the second embodiment, individual medicine discharge devices may be arranged together with the medicine cassette within the automatic medicine packing machine.

Similar to the medicine discharge device according to the above described first embodiment, the frame 60 according to the second embodiment incorporates the gate unit, an opening/closing degree of which is adjusted to pass a medicine one by one therethrough, the drive unit to apply an opening/closing drive force to the gate unit, the one or more detection sensors to monitor normal transfer of a medicine, and the discharge passage 19 to guide a medicine to be discharged.

Although the first embodiment illustrates the gate members being opened or closed as drive force of the motor is transmitted to the gate members via the pulling strings, according to the second embodiment, gate members are opened or closed in a cam driven manner.

As shown in FIG. 14, the gate unit according to the second embodiment includes a pair of left and right gate members 61*a* and 61*b*, and an elastic member (not shown) to keep the gate members 61*a* and 61*b* in a closed state. The elastic member may be installed to connect the left and right gate members 61*a* and 61*b* to each other in the same manner as the first embodiment. Alternatively, two elastic members may be installed respectively around rotating shafts of the gate members 61*a* and 61*b*.

The drive unit, which functions to open the gate members 61*a* and 61*b* in opposition to elasticity of the elastic member, includes a cam member 16 to be rotated by the drive motor 14, an approximately U-shaped driving member 17 to be rectilinearly moved under guidance of the cam member 16, and rollers 18 arranged at opposite ends of the driving member 17 to come into contact with rolling surfaces 61*aa* and 61*ba* of the left and right gate members 61*a* and 61*b*.

If the cam member 16 is rotated by rotation of the drive motor 14, the driving member 17 is rectilinearly moved. In this case, the rollers 18 of the driving member 17 press the rolling surfaces 61*aa* and 61*ba* of the gate members 61*a* and 61*b*, allowing the gate members 61*a* and 61*b* to be pivotally rotated and opened.

To allow the driving member 17 to always come into close contact with the cam member 16, elastic members, such as coil springs, etc., are used to press the driving member 17 toward the cam member 16.

Although not shown, the frame 60 may incorporate thereon the one or more detection sensors to confirm whether or not the medicine passes through the gate unit. In addition, although the discharge passage 19 of the second embodiment slightly differs from the discharge passage 19 of the first embodiment in view of a shape, the discharge passage 19 performs the same function of transferring an irregularly-shaped medicine, discharged, i.e. dropped from the plate, to the medicine transfer unit 80 and thus, is designated by the same reference numeral.

Similar to the medicine discharge device according to the above described first embodiment, the vibration unit according to the second embodiment includes the vibrator 21 to generate vibration, and the plate 22 attached to the vibrator 21 so as to be vibrated together with the vibrator 21.

Here, since the vibrator 21 and the plate 22 according to the second embodiment are equal or similar to those of the above described first embodiment, for convenience of description, the same or like constituent elements as those of the first embodiment are designated by the same reference numerals, and a detailed description thereof is omitted herein.

In addition, similar to the medicine discharge device according to the above described first embodiment, the supporting unit according to the second embodiment includes the bottom plate 31 on which the vibration unit is mounted, and the vibration-proof member 33 interposed between the vibration unit and the bottom plate 31. However, differently from the first embodiment wherein the frame is supported by the plurality of supporting rods, according to the second embodiment, a casing 35 may be provided to enclose the medicine discharge device so as to conceal the interior configuration of the medicine discharge device, and e.g., the bottom plate 31 and the frame 60 may be mounted and supported within the casing 35. In FIG. 13, a sidewall of the casing 35 is omitted to reveal the interior configuration of the medicine discharge device.

The vibration-proof member 33 of the second embodiment is made of the same material as that of the above described first embodiment and thus, a detailed description thereof is omitted herein. However, differently from the first embodiment wherein the vibration-proof member 33 is located between the vibration unit and the bottom plate 31, according to the second embodiment, two vibration-proof members 33 may be arranged above and below the bottom plate 31 interposed therebetween, and the vibrator 21 may be connected to the two vibration-proof members 33.

The medicine input unit 70 according to the second embodiment, as shown in FIGS. 15 and 16, includes a cylindrical (see FIG. 13) or a funnel-shaped (see FIGS. 15 and 16) upper input body 71 in which a medicine is received, a lower input body 73 located under the upper input body 71 and having an opening 73*a* for discharge of a medicine, and a rotatable opening/closing member 75 to be rotated by a motor 74 within the lower input body 73 so as to open or close the opening 73*a*.

The rotatable opening/closing member 75 has an oblique upper surface as shown in the drawing, allowing the opening 73*a* to be repeatedly opened and closed by rotation thereof. The rotatable opening/closing member 75 may also serve to prevent the medicine received in the upper and lower input bodies 71 and 73 from clumping together and thus, may eliminate a risk of delay in discharge.

Although FIG. 15 illustrates the upper input body 71 and the lower input body 73 as being separately prefabricated and assembled with each other, of course, the upper input body 71 and the lower input body 73 may be fabricated as a single member.

In addition, as shown in FIG. 16, a rotating shaft 74*a* of the motor 74 is preferably separably coupled into a rotating shaft 75*a* of the rotatable opening/closing member 75. The separable coupling of the rotatable opening/closing member 75 may assure easy cleaning and maintenance/repair of the medicine input unit 70.

The medicine received in the upper input body 71 is fed to the accommodation portion 23 of the plate 22 at random whenever the opening 73*a* is opened by the rotatable opening/closing member 75. As described above with reference to the first embodiment, the medicine fed to the accommodation portion 23 is moved to the recess 24 of the plate 22 by vibration, so as to be discharged one by one. In this case, the medicine fed to the accommodation portion 23 may be aligned by the gate unit prior to being moved to the recess 24.

After being discharged one by one through the recess 24 and the discharge passage 19, the medicine is transferred to the hopper 130 by the medicine transfer unit 80 and then, is packed.

Referring to FIG. 17, the medicine transfer unit 80 includes a pivoting discharge member 81 pivotally rotatably provided under the discharge passage 19 of the frame 60, a connection passage 83 provided under the pivoting discharge member 81 to transfer a medicine to the hopper 130, and a collection passage 85 provided under the pivoting discharge member 81 to collect a medicine not transferred to the hopper 130 into a collector vessel (not shown).

Figure 19:
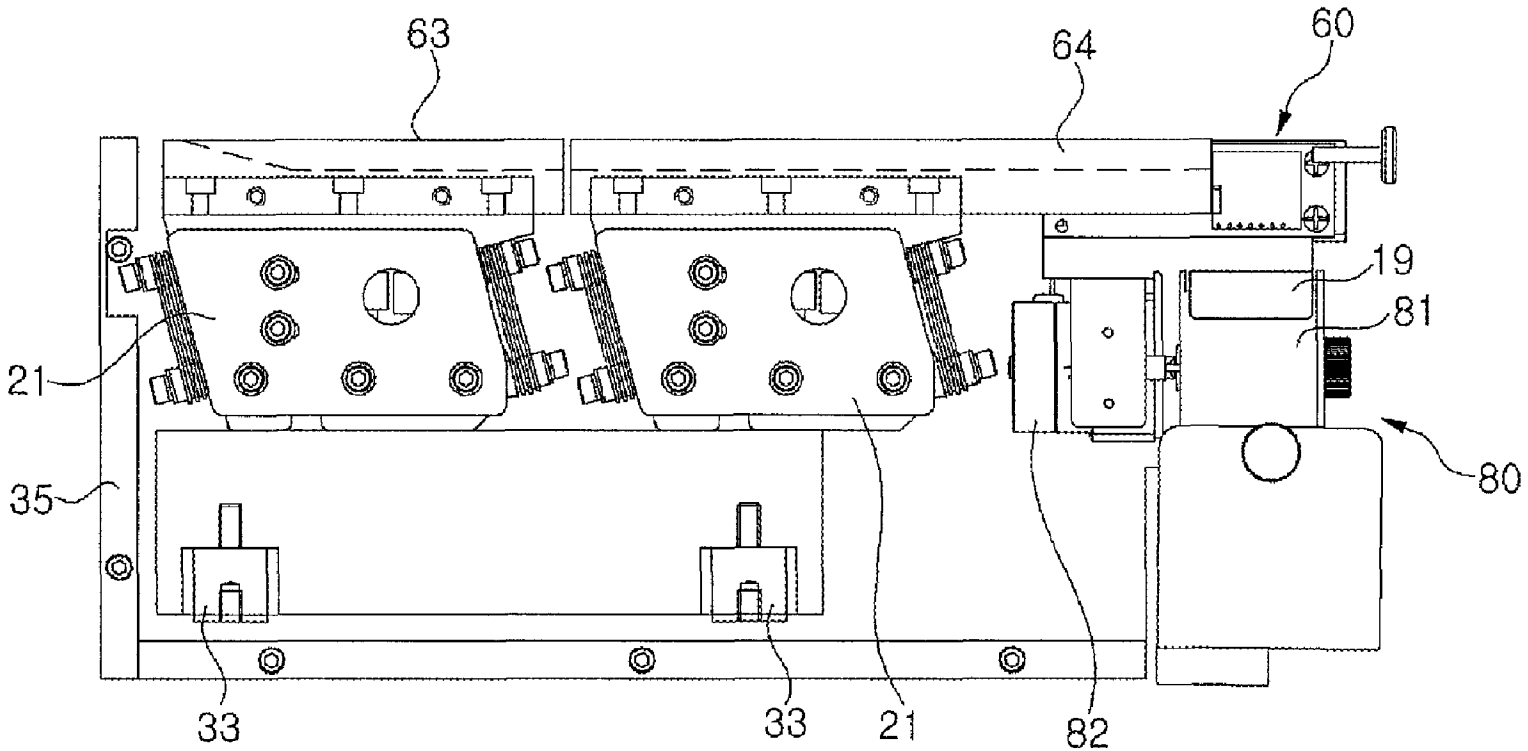
FIG. 19 is a side view illustrating an alternative embodiment of the medicine discharge device according to the second exemplary embodiment of the present invention.

The pivoting discharge member 81 is installed pivotally rotatable within a predetermined angular range by a motor 82 (see FIG. 19). A transfer passage 81*a* vertically penetrates through the interior of the pivoting discharge member 81. By adjusting a pivoting angle of the pivoting discharge member 81, it is possible to allow the medicine, discharged from the discharge passage 19, to be selectively transferred to the connection passage 83 or the collection passage 85.

Referring to FIG. 18 illustrating an alternative embodiment of the medicine transfer unit 80, another pivoting discharge member 86 is disclosed. Differently from the pivoting discharge member 81 having the transfer passage 81*a* defined therein according to the above described embodiment with reference to FIG. 17, the pivoting discharge member 86 shown in FIG. 18 includes a pair of concave receptacles 86*a* diametrically opposite each other.

The receptacles 86*a* are adapted to temporarily receive a medicine dropped from the plate 22. Once a preset number of tablets of medicine drops into the receptacles 86*a*, the pivoting discharge member 86 is pivotally rotated clockwise or counterclockwise by an angle of 180 degrees, acting to selectively transfer the medicine received in the receptacles 86*a* to the collection passage 85 (upon clockwise rotation) or the connection passage 83 (upon counterclockwise rotation).

Figure 21:
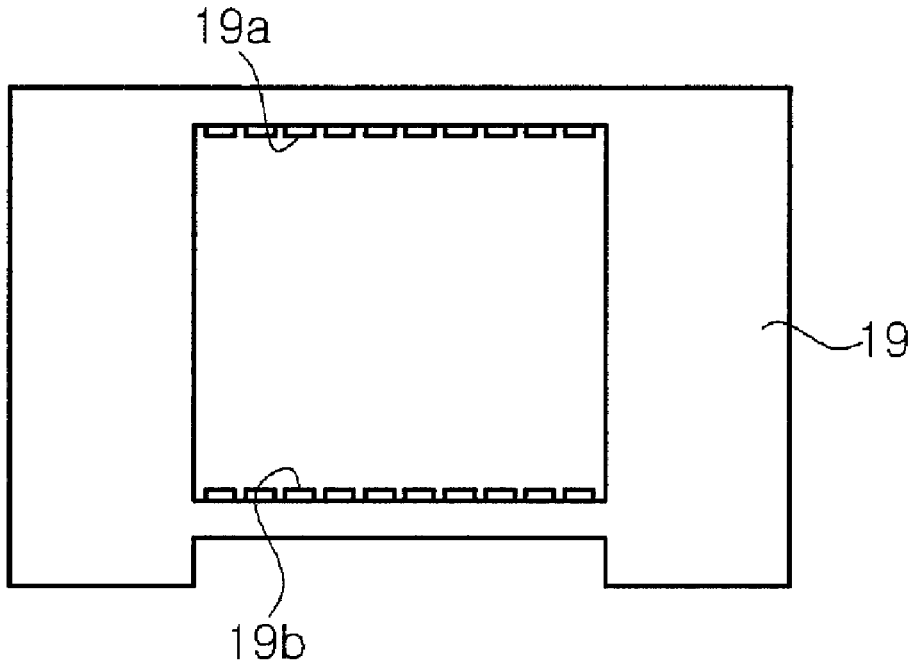
FIG. 21 is a plan view of a discharge passage provided with a sensor according to the second exemplary embodiment of the present invention.
Figure 22:
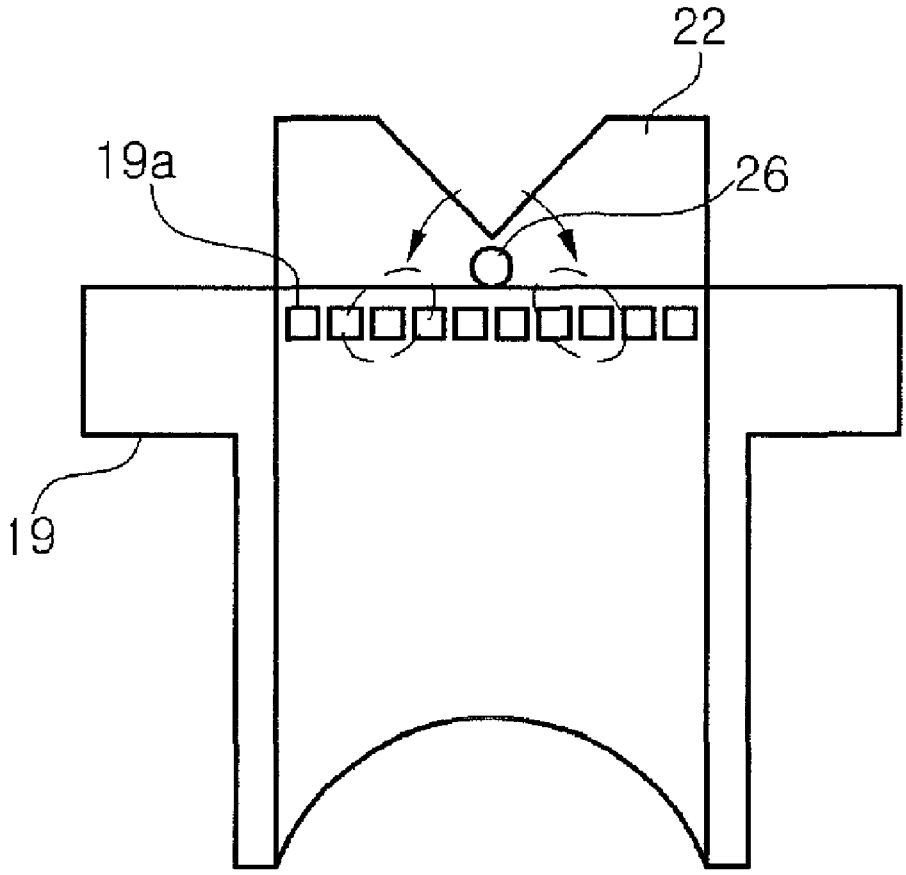
FIG. 22 is a view illustrating operation of the sensor with respect to the discharge passage.

The number of tablets of medicine dropped from the plate 22 may be counted by a sensor provided in the discharge passage 19. As shown in FIGS. 13, 21 and 22, the sensor 19 may be a photo sensor consisting of a light emitter 19*a* and a light receiver 19*b*.

To assure efficient counting operation of the sensor provided in the discharge passage 19, a pin member 26 protrudes from the distal end of the plate 22 and serves to temporarily reduce a drop speed of each tablet of medicine. More specifically, when a tablet of medicine drops from the distal end of the recess 24 of the plate 22, the tablet is first temporarily caught by the pin member 26 and then, is slightly moved leftward or rightward around the circular pin member 26. This has the effect of temporarily reducing a drop speed of the tablet. As a result, the sensor provided in the discharge passage 19 may perform a sensing operation at an increased accuracy.

According to the present invention, it is desirable that a plurality of light emitters 19*a* and a plurality of light receivers 19*b* be arranged respectively in a line. As shown in FIGS. 21 and 22, for example, assuming that the sensor includes ten light emitters 19*a* and ten light receivers 19*b*, the sensor may accurately count the number of tablets of medicine even when two tablets drop from the plate 22 substantially simultaneously.

Referring to FIG. 22, when two tablets of medicine drop from the plate 22 substantially simultaneously, the two tablets are first caught by the pin member 26 provided at the distal end of the plate 22 and then, are moved respectively leftward or rightward around the circular pin member 26. In this case, since the two substantially simultaneously dropped tablets interfere with each other, one tablet is moved leftward around the pin member 26 and the other tablet is moved rightward around the pin member 26.

If only one light emitter 19*a* and only one light receiver 19*b* are provided when the two tablets drop substantially simultaneously as described above, it may be impossible to identify whether the two tablets drop simultaneously or only one tablet drops, although the sensor may sense the drop of the tablet(s).

However, since the present invention features the plurality of light emitters 19*a* and the plurality of light receivers 19*b*, a left one of the two dropped tablets may be sensed by second to fourth light emitters 19*a* and light receivers 19*b* from the left side of the drawing, and a right one of the two dropped tablets may be sensed by seventh to ninth light emitters 19*a* and light receivers 19*b*. In this case, since fifth and sixth light emitters 19*a* and light receivers 19*b* fail to sense the tablets, it can be said that a total of two tablets drop. That is, it can be said that two tablets drop substantially simultaneously if some middle ones of the plurality of light emitters 19*a* and light receivers 19*b* fail to sense the tablets.

The medicine discharge device of the present invention may further include an opening/closing cover (not shown) provided above the plate 22.

In addition, according to the present invention, the plate 22 may be made of a transparent material and a detection sensor may be integrally mounted in the plate 22.

The medicine discharge device according to the second embodiment may be configured to feed a desired number of tablets of medicine to a packing device at a predetermined packing interval during which a medicine received in the medicine cassette of the automatic medicine packing machine is discharged and packed. In this case, the installation number and position of the medicine discharge device may be changed based on a design demand.

Of course, the medicine discharge device according to the second embodiment of the present invention may also be used to discharge a general medicine, such as circular or elliptical tablets or capsules, in addition to an irregularly-shaped medicine.

Figure 20:
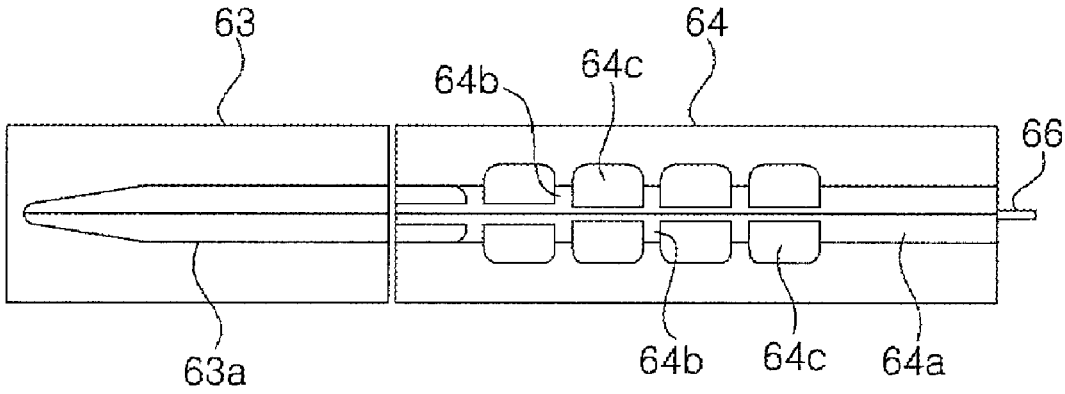
FIG. 20 is a plan view illustrating a plate of the medicine discharge device according to the alternative embodiment of FIG. 19.

FIG. 19 is a side view of an alternative embodiment of the medicine discharge device according to the second embodiment of the present invention, and FIG. 20 illustrates a plate of the medicine discharge device according to the alternative embodiment.

The alternative embodiment differs from the above described second embodiment in view of the fact that the vibration unit includes two plates and two vibrators 21 to vibrate the respective plates at different vibration frequencies. Since other configurations of the alternative embodiment are equal to those of the above described second embodiment, the same constituent elements are designated by the same reference numerals and a detailed description thereof is omitted herein.

As shown in FIGS. 19 and 20, the plates according to the alternative embodiment may include a first plate 63 arranged at a position corresponding to the accommodation portion 23 of the second embodiment, and a second plate 64 arranged at a position corresponding to the recess 24 of the second embodiment.

The first plate 63 and the second plate 64 are spaced apart from each other, and are formed respectively with a first recess 63*a* and a second recess 64*a*. The first recess 63*a* and the second recess 64*a* are aligned with each other.

The first plate 63 and the second plate 64 are vibrated respectively by the individual vibrators 21 as described above and thus, may have different vibration frequencies from each other. For example, the second plate 64 from which a medicine is discharged, may be vibrated faster than the first plate 63 to which a medicine is fed.

To prevent circular or elliptical tablets of medicine from rolling in the recesses and consequently, to prevent the tablets from clumping, the second recess 64*a* may be formed with one or more convex portions 64*b* and one or more concave portions 64*c*. Alternatively, according to the present invention, the second recess 64*a* may be formed with only the convex portions 64*b* or only the concave portions 64*c*.

In addition, as described above, the pin member 66 protrudes from a distal end of the plate 64 to temporarily reduce a drop speed of a medicine so as to enable more accurate counting of the medicine. The medicine dropped from a distal end of the second recess 64*a* of the plate 64 is caught by the pin member 66 and is slightly moved leftward or rightward around the pin member 66, thereby being dropped with a temporarily reduced speed. Accordingly, the sensor provided in the discharge passage 19 may more accurately sense the drop of a medicine.

As is apparent from the above description, the present invention provides a medicine discharge device usable with an automatic medicine packing machine, which is designed to discharge a medicine one by one via vibration. With use of the medicine discharge device, it is possible to accurately individually discharge not only a standard shape of medicine, but also a non-standard irregularly-shaped medicine, such as a half tablet.

Although the preferred embodiments of the medicine discharge device according to the present invention have been disclosed for illustrative purposes, those skilled in the art will appreciate that various modifications, additions and substitutions are possible, without departing from the scope and spirit of the invention as disclosed in the accompanying claims.

What is claimed is:

1. A medicine discharge device of an automatic medicine packing machine, which is used to discharge a medicine, fed from a medicine cassette based on a medical prescription, into a medicine packing device, the medicine discharge device comprising:

a medicine input unit installed under a medicine cassette mount, the medicine input unit being adapted to receive the medicine fed from the medicine cassette based on the medical prescription under control of a control unit and to discharge the medicine downward;

a frame provided with a gate unit, the gate unit including a pair of gate members adapted to be opened or closed by a drive unit so as to control movement of the medicine discharged from the medicine input unit;

a plate installed under the frame and having an accommodation portion to receive the medicine in a space surrounded by the frame and the pair of gate members and a recess to allow the medicine having passed through the gate members to be moved to a discharge passage;

a vibrator to vibrate the plate; and a medicine transfer unit to discharge the medicine, having passed through the recess, into a hopper, so as to discharge the medicine into the medicine packing device.

2. The medicine discharge device according to claim 1, wherein the medicine input unit includes:

a medicine input body separably mounted in the automatic medicine packing machine in a sliding movable manner;

an intermediate hopper separably inserted in the medicine input body to receive the medicine; and an opening/closing door installed to be pivotally rotated about a pivot shaft based on a signal from the control unit so as to open or close a bottom of the intermediate hopper.

3. The medicine discharge device according to claim 1, wherein the medicine input unit includes:

a cylindrical or a funnel-shaped upper input body to receive the medicine so as to allow the medicine to be discharged to the accommodation portion;

a lower input body located under the upper input body and having an opening for discharge of the medicine; and a rotatable opening/closing member adapted to be rotated by a motor within the lower input body so as to open or close the opening.

4. The medicine discharge device according to claim 1, wherein the frame is further provided with a first detection sensor at a position immediately downstream of the gate unit to confirm whether or not the medicine, which has been discharged from the medicine input unit to the accommodation portion, passes through the gate unit, and a second detection sensor to confirm whether or not the medicine is discharged from the plate.

5. The medicine discharge device according to claim 1, wherein the discharge passage is provided with a sensor to monitor whether or not the medicine passes through the discharge passage and to count the medicine to be discharged, the sensor including a plurality of light emitters and light receivers.

6. The medicine discharge device according to claim 5, wherein a pin member protrudes from a distal end of the plate so that the medicine dropped from the plate is temporarily caught by the pin member, the pin member serving to temporarily reduce a drop speed of the medicine so as to assure an accurate counting operation by the sensor.

7. The medicine discharge device according to claim 1, wherein the plate is made of a transparent material and a detection sensor is integrally mounted in the plate.

8. The medicine discharge device according to claim 7, wherein the plate includes a first plate and a second plate spaced apart from each other, and the vibrator includes a pair of vibrators to vibrate the first plate and the second plate individually.

9. The medicine discharge device according to claim 1, wherein the drive unit includes:

an elastic member connected between the pair of gate members;

pulling strings connected respectively to the pair of gate members; and a rotating member to wind or unwind the pulling strings by operation of a drive motor.

10. The medicine discharge device according to claim 1, wherein the drive unit includes:

a cam member adapted to be rotated by a drive motor;

a driving member adapted to be rectilinearly moved under guidance of the cam member; and rollers arranged at opposite ends of the driving member to come into contact with rolling surfaces of the gate members, and wherein the driving member is pressed toward the cam member by an elastic member, so as to continuously come into close contact with the cam member.

11. The medicine discharge device according to claim 1, wherein the recess generally has a U-shaped or V-shaped cross section, and consists of linear regions and tapered regions arranged alternately along a center axis thereof.

12. The medicine discharge device according to claim 1, wherein the recess is formed with at least one of a convex portion and a concave portion to prevent rolling of the medicine being moved along the recess.

13. The medicine discharge device according to claim 1, wherein the medicine transfer unit includes:

an auxiliary hopper installed to be rectilinearly movable forward or rearward between a rearwardly moved position where the medicine, discharged from the discharge passage, drops into the hopper and a forwardly moved position where the medicine, discharged from the discharge passage, drops into a collector vessel that is used to collect residual medicine remaining after completion of a medicine packing operation; and a rectilinear movement unit to rectilinearly move the auxiliary hopper forward or rearward using a motor and a screw rod to be rotated by the motor.

14. The medicine discharge device according to claim 1, wherein the medicine transfer unit includes:

a pivoting discharge member installed to the frame and adapted to be pivotally rotated by a motor so as to convert a discharge direction of the medicine from the discharge passage;

a connection passage provided under the pivoting discharge member to transfer the medicine from the pivoting discharge member to the hopper;

a collection passage arranged parallel to the connection passage under the pivoting discharge member to collect a medicine not transferred to the hopper; and a transfer passage vertically penetrating through the interior of the pivoting discharge member to selectively transfer the medicine from the pivoting discharge member to the connection passage or the collection passage by adjusting a pivoting angle of the pivoting discharge member.

15. The medicine discharge device according to claim 14, wherein the pivoting discharge member includes a concave receptacle to temporarily receive the medicine, the medicine received in the receptacle being selectively transferred to the collection passage or the connection passage as the pivoting discharge member is pivotally rotated clockwise or counterclockwise.

* * * * *